US006755510B2

(12) United States Patent
Murakami et al.

(10) Patent No.: US 6,755,510 B2
(45) Date of Patent: Jun. 29, 2004

(54) INK JET RECORDING HEAD

(75) Inventors: Shuichi Murakami, Kanagawa (JP); Michinari Mizutani, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/419,843

(22) Filed: Apr. 22, 2003

(65) Prior Publication Data

US 2003/0202041 A1 Oct. 30, 2003

(30) Foreign Application Priority Data

Apr. 23, 2002 (JP) ..... 2002-121203

(51) Int. Cl.[7] ..... B41J 2/045; B41J 2/04

(52) U.S. Cl. ..... 347/63; 347/54

(58) Field of Search ..... 347/63, 56, 54, 347/68, 69, 70, 71, 72, 50, 40, 20, 44, 47, 27, 84; 399/261; 361/700; 310/328–330; 29/890.1

(56) References Cited

U.S. PATENT DOCUMENTS 6,280,020 B1 8/2001 Tachihara et al.
6,350,016 B1 2/2002 Tachihara et al.
6,520,626 B1 2/2003 Murakami
2002/0054181 A1 5/2002 Murakami
2002/0196301 A1 12/2002 Murakami et al.
2002/0196309 A1 12/2002 Murakami et al.
2003/0058305 A1 3/2003 Murakami et al.
2003/0067508 A1 4/2003 Mizutani et al.

*Primary Examiner*—Raquel Yvette Gordon
(74) *Attorney, Agent, or Firm*—Fitzpatrick, Cella, Harper & Scinto

(57) ABSTRACT

An ink jet recording head is the one having discharge ports for discharging liquid droplets in different discharge amounts intermixed therefor, and formed by a recording element substrate provided with the discharge portion having comparatively small discharge port, in particular, for discharging liquid in a comparatively small amount, and another recording element substrate provided with the discharge port having comparatively large discharge port, in particular, for discharging liquid in a comparatively large amount. Near the small discharge port, opening communicated with the discharge portion and open to the opening surface of the discharge port is provided. With the structure thus arranged, it is made possible to appropriately perform the suction recovery process with ease.

20 Claims, 19 Drawing Sheets

INK JET RECORDING HEAD

BACKGROUND OF THE INVENTION

1. Field of the Invention

The present invention relates to an ink jet recording apparatus for forming ink liquid droplets by discharging ink for the performance of recording. The invention also relates to an ink jet recording head used for such recording apparatus.

2. Related Background Art

It is generally practiced to provide a printer, a copying machine, a printing device for facsimile equipment or the like with the structure that prints images formed by dot patterns on a printing medium, such as paper, thin plastic sheet, or cloths, among some others, in accordance with image information. The printing apparatuses of the kind are classified into those using ink jet method, wire-dot method, thermal method, and laser beam method depending on the printing method adopted by each of them.

Of those ones, the ink jet method is such as to perform printing by discharging ink from a recording head to a printing medium. The ink jet method makes it possible to print images in high precision at high speed. Further, being of non-impact type, noises are smaller with such advantage that it is easier to print color images by use of multiple color ink.

Of the ink jet methods currently available, the bubble jet printing method invented by the applicant hereof makes it possible to discharge ink by the utilization of pressure exerted when liquid is heated to bubble. For the bubble jet printing method, heaters that heat liquid can be arranged in high density easily. Thus, as an advantage, among many, that this method provides, an apparatus can be structured with ease for the performance of high-resolution printing at high speed.

For the ink jet recording apparatus of bubble jet printing method, ink is usually used as printing liquid. Therefore, with the evaporation of ink, its viscosity may change or with possible mixture of bubbles in ink, the performance of ink discharge is affected by such causes to produce unfavorable effect on prints in some cases.

More specifically, at the early stage of the installation of an ink jet recording head on an ink jet recording apparatus or at the time of exchanging ink tanks, the mixture of bubbles occurs in ink when ink is filled in the ink jet recording head. Also, as time elapses, even in a state where ink is filled in the ink jet recording head, the air may be allowed to enter the discharge ports that discharge ink or fitting portions of ink supply passages. Then, in some cases, bubbles may be created in ink. If such bubbles exist in a large amount in the vicinity of ink discharge portion, discharges are disabled (causing non-discharge) to change the ink discharge amounts and discharge speeds, hence impeding the normal recording in some cases.

Here, therefore, it is necessary to adopt the technology and technique specially made available for reliably maintaining the ink discharge function of the recording head for an ink jet recording apparatus. Among such technologies and techniques, there is known a method in which suction recovery process is executed to suck ink, which resides in the vicinity of the discharge portion, from the recording head for appropriately removing mixed bubbles and overly viscous ink together with ink thus sucked out. The head recovery device that executes the suction recovery process is generally structured with a cap for capping, which closely covers the discharge port surface where discharge ports of the recording head are open, and a suction pump that performs suction inside the cap. The suction recovery process executed by the head recovery device is such that the recording head moves to the position facing the cap, and after capping, the inside of the cap is sucked by use of the suction pump, and then, bubbles and overly viscous ink in the recording head are sucked and removed together with ink sucked out at that time. The suction recovery process of the kind is now an important art among the technologies and techniques for reliably maintaining an ink jet recording apparatus.

In recent years, it has been required that the ink jet recording apparatus should record images in the so-called high quality having precisely adjusted gradation therefor. As one of the methods that make the formation of such images possible, it is devised to provide the discharge units for one recording head in order to discharge liquid droplets in different discharge amounts. In such a case, the balance required for desirable performance of discharges may differ on various aspects per discharge unit, which makes it impossible to execute any stabilized operation of recording sometimes.

For example, usually, for the discharge portion where liquid droplet is discharged in a comparatively large amount (hereinafter referred to as a large discharge portion), the discharge port area and the sectional area of the flow path communicated with the discharge port are made larger than the discharge portion where liquid droplet is discharged in a comparatively small amount (hereinafter referred to as a small discharge portion). As a result, the flow resistances in the large discharge portion and the small discharge portion are made different greatly. Therefore, the characteristics of bubble removal become different when these portions are covered by one cap, and the suction recovery process is made under the same condition.

Also, as compared with the large discharge portion, the small discharge portion is easier to be affected by the higher viscosity of ink resulting from evaporation, because the area of the discharge port is smaller to make the flow resistance higher. Consequently, when a recording operation is executed after a specific time elapses without any recording operation, there is a fear that non-discharge takes place in the small discharge portion at the time of the first shot of ink or there is encountered a phenomenon (called viscous plug phenomenon) that a desired amount of discharge cannot be obtained.

Also, the characteristics of refilling, that is, the refilling of liquid subsequent to the liquid discharge, are made different in the large discharge portion and the small discharge portion, thus resulting in a fear that stabilized liquid discharges cannot be performed.

Also, if a structure is arranged so that liquid is supplied from one liquid supply port to the large discharge portion and the small discharge portion, the vibration of liquid exerts influence on the small discharge portion nearby, which is propagated from the large discharge portion when liquid is discharged from that portion, and there is a fear that stabilized liquid discharges cannot be performed.

SUMMARY OF THE INVENTION

Now, therefore, with attention given to the technical problems discussed above with respect to the conventional art, the present invention is designed. It is an object of the invention to provide an ink jet recording head with intermixed large discharge portion and small discharge portion, which is capable of performing stabilized recording with various balances well kept for the large and small discharge portions, and also, to provide an ink jet recording apparatus having such ink jet recording head mounted thereon.

It is another object of the invention to provide an ink jet recording head with intermixed large discharge portion and small discharge portion, for which it is attempted to reduce the influence of liquid vibrations propagated when liquid is discharged from discharge ports nearby in the small discharge portion, while enhancing the refilling characteristics in the small discharge portion to make stabilized recording possible, and also, to provide an ink jet recording apparatus having such ink jet recording head mounted thereon.

In order to achieve the aforesaid objects, the ink jet recording head of the present invention comprises a first discharge portion for discharging liquid from a first discharge port as liquid droplet in a specific amount, a second discharge portion for discharging liquid from a second discharge port as liquid droplet in a larger amount than that of the first discharge portion, and an opening provided only for the first discharge portion, being open to the opening surface of the first discharge port and communicated with the first discharge port without discharging liquid droplet.

With the structure thus arranged, it is made possible to enable the flow resistance of the discharge port portion having the small discharge amount of liquid to be discharged to be close to the flow resistance of the discharge portion having the large discharge amount of liquid to be discharged when suction recovery process is executed. Therefore, even if the discharge ports of discharge portions, both of them, are covered by one cap for the execution of the suction recovery process, liquid can be sucked out equally from both of them, hence making it possible to perform the process appropriately for both of them. Also, for the discharge portion having the small discharge amount of liquid to be discharged, it is possible to execute the suction recovery process in good condition by enabling a comparatively small suction to act thereon. As a result, it becomes possible to reduce such drawback, as deformation or breakage of the discharge port plate, which may be caused by the suction recovery process.

Also, with the provision of the aforesaid opening, it is made possible to raise the environmental moisture in the vicinity of the discharge ports of the discharge portion having the small amount of liquid to be discharged. As a result, even if discharge is not made for a certain period of time, it becomes possible to suppress making the viscosity of ink higher in the vicinity of such discharge ports, thus reducing the occurrence of the viscous plug phenomenon. Furthermore, it is made possible to reduce the influence of liquid vibrations exerted in the small discharge portion, which is propagated at the time of discharging liquid from the discharge ports nearby, so as to obtain the action that may stabilize discharges, and also, it is possible to obtain the action that may accelerate the refilling speed in the small discharge portion by the function of capillary force on the opening portion when liquid is refilled again after liquid is discharged, that is, when refilling is executed.

At least for the two kinds of discharge portions having different discharge amounts of liquid to be discharged, the discharge port of the first discharge portion having the small amount of liquid to be discharged is often structured to be smaller than the discharge port of the second discharge portion having the large amount of liquid to be discharged. The present invention is applicable to the ink jet recording head, which is provided with intermixed discharge portions the discharge ports of which are formed in different sizes, in particular.

Also, the ink jet recording head of the present invention may be structure in such a way that the first discharge portion is provided on the substrate, and provided with a first energy generating element for generating energy to discharge liquid droplet; the first discharge port provided to face the first energy generating element; and a first liquid flow path communicated with the first discharge port for supplying liquid onto the first energy generating element, and the second discharge portion is provided on the substrate, and provided with a second energy generating element for generating energy to discharge liquid droplet; the second discharge port provided to face the second energy generating element; and a second liquid flow path communicated with the second discharge port for supplying liquid onto the second energy generating element, and the opening is provided for the first flow path communicated with the first discharge port.

In this case, the structure may be arranged so that the first discharge portion and the second discharge portion are provided for one substrate, and liquid is supplied from one liquid supply port arranged as a penetrated opening for the substrate to the first liquid flow path and the second liquid flow path, respectively.

Also, for the ink jet recording head of the present invention, the structure may be arranged so that a first liquid supply port for supplying liquid to the first discharge port and a second liquid supply port for supplying liquid to the second discharge port are provided, respectively, and the opening is provided on the projected area of the opening surface of the first liquid supply port.

In accordance with the present invention, if the first discharge port is provided in the plural number, it is preferable to arrange openings corresponding to the first discharge ports each individually. Then, the suction recovery process can be executed for all the discharge portions appropriately.

For the present invention, there are conceivably various modes as to the positions of the opening, the sizes and shapes thereof as those obtaining preferable functions, such as making the liquid flow easier at the time of executing the suction recovery process in the location where mixed bubbles tend to remain, among some others.

In other words, it is preferable for one mode to position the opening more backward in the liquid flow path than the discharge port as observed in the direction of liquid supply to the discharge port. In this case, the size of the opening should preferably be larger than the discharge port on the discharge portion having the large amount of liquid to be discharged.

Also, for another mode, it is preferable for another mode to position the opening more forward in the liquid flow path than the discharge port as observed in the direction of liquid supply to the discharge port. In this case, the size of the opening should preferably be smaller than the discharge port on the discharge portion having the small amount of liquid to be discharged. Also, it is preferable to configure the opening in such a shape that the width of the portion on the side nearer to the discharge port is made larger.

Also, for the structure having the discharge ports communicated with plural discharge portions, which are connected with the supply source of liquid and open in the direction toward the surface where the discharge ports are formed, each opening may be arranged on each supply port or more on the discharge port side than the supply port.

Also, the opening may be arranged on the extend line of the liquid flow path wall that separates the flow path of the discharge portion having the small amount of liquid to be discharged from the liquid flow path of the adjacent discharge portion, which is extended in the direction of liquid supply, or may be arranged on the center line extended from the liquid flow path of the discharge portion having the small amount of liquid to be discharged, which is extended in the direction of liquid supply.

The present invention creates action to perform the suction recovery process in good condition for the ink jet recording head provided with a small discharge portion having a small discharge amount of liquid to be discharged. Therefore, the present invention is preferably applicable to an ink jet recording head that adopts the method in which film boiling is given to liquid by means of electrothermal converting members, which makes highly precise image recording possible by use of small liquid droplets. Particularly, among such methods currently available, this invention is preferably applicable to the ink jet recording head that enables bubbles generated by film boiling to be communicated with the atmosphere.

Also, the ink jet recording apparatus of the present invention is provided with the aforesaid ink jet recording head, and the suction recovery unit, which sucks liquid from the discharge portions of the ink jet recording head.

In accordance with the present invention, the aforesaid suction recovery unit is provided with a cap that covers and airtightly closes the opening surface of the discharge ports, and a suction pump for sucking liquid from the discharge ports and the opening covered by the cap. Here, it may be possible to arrange so that the suction pump sucks liquid from at least the two kinds of discharge portions of the ink jet recording head substantially on the same condition. Further, the cap may cover at least two kinds of discharge port portions together.

BRIEF DESCRIPTION OF THE DRAWINGS

FIG. 1A is a perspective view; and FIG. 1B is a cross-sectional view taken along line 1B to 1B in FIG. 1A.

FIG. 2A is a plan view; and FIG. 2B is a cross-sectional view taken along line 2B—2B in FIG. 2A.

FIG. 3A is a perspective view; and FIG. 3B is a cross-sectional view taken along line 3B—3B in FIG. 3A.

FIG. 4A is a plan view; and FIG. 4B is a cross-sectional view taken along line 4B—4B in FIG. 4A.

FIG. 15A is a perspective view; and FIG. 15B is a cross-sectional view taken along line 15B—15B in FIG. 15A.

FIG. 16A is a plan view; and FIG. 16B is a cross-sectional view taken along line 16B—16B in FIG. 16A.

FIG. 18A is a perspective view; and FIG. 18B is a cross-sectional view taken along line 18B—18B in FIG. 18A.

FIG. 19A is a plan view; and FIG. 19B is a cross-sectional view taken along line 19B—19B in FIG. 19A.

FIG. 20A is a plan view; FIG. 20B is a cross-sectional view taken along line 20B—20B in FIG. 20A; and FIG. 20C is a cross-sectional view taken along line 20C—20C in FIG. 20A.

DETAILED DESCRIPTION OF THE PREFERRED EMBODIMENTS

Hereinafter, with reference to the accompanying drawings, the description will be made of the embodiments in accordance with the present invention.

(First Embodiment)

At first, with reference to FIG. 5 to FIG. 7, the description will be made of the entire structure of the ink jet recording apparatus on which the ink jet recording head of the present invention is mounted. FIG. 7 is a perspective view that shows the principal part of the ink jet recording apparatus, which is illustrated in a state where the outer members are removed in order to show the inner structure thereof.

The ink jet recording apparatus is provided with an automatic feeding unit 50 that feeds mediums stacked on it one by one, and a conveying unit 53 that conveys the recording medium thus fed along the specific path. Also, on the extended line of the conveying path, there are provided an expeller roller (not shown) that expels the recording medium to the outside of the apparatus after the completion of recording thereon, and a tray to receive such expelled medium. Above the conveying path of recording medium, a carriage shaft 52 supports a carriage 51 to reciprocate in the direction intersecting the conveying direction of the medium, particularly in the direction at right angles thereto. Although not shown in FIG. 7, a head cartridge, which is provided with an ink jet recording head unit, is detachably mounted on the carriage 51.

Figure 5:
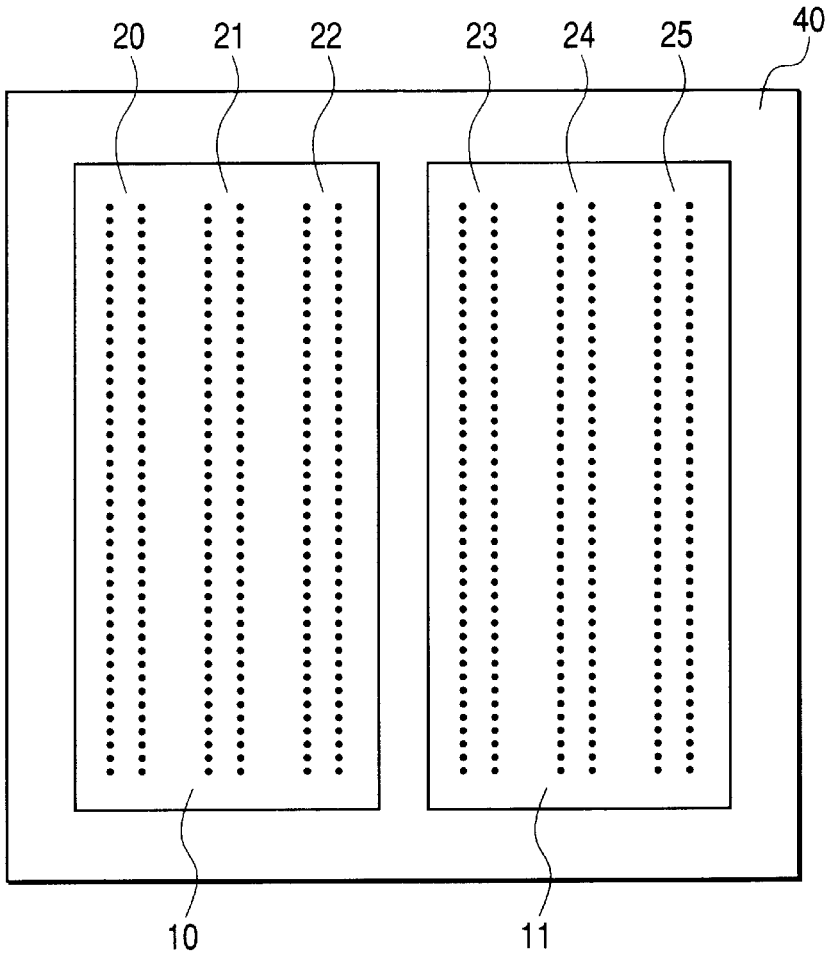
FIG. 5 is a plan view that shows the ink jet recording head provided with the recording element substrate represented in FIGS. 1A and 1B, and FIGS. 3A and 3B.
Figure 6:
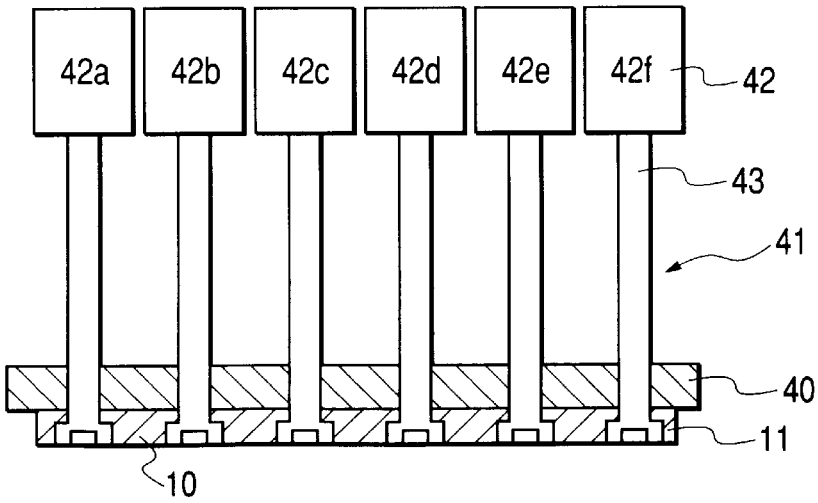
FIG. 6 is a view that schematically shows the structure of a head cartridge provided with the ink jet recording head having the recording element substrate represented in FIGS. 1A and 1B, and FIGS. 3A and 3B.
Figure 7:
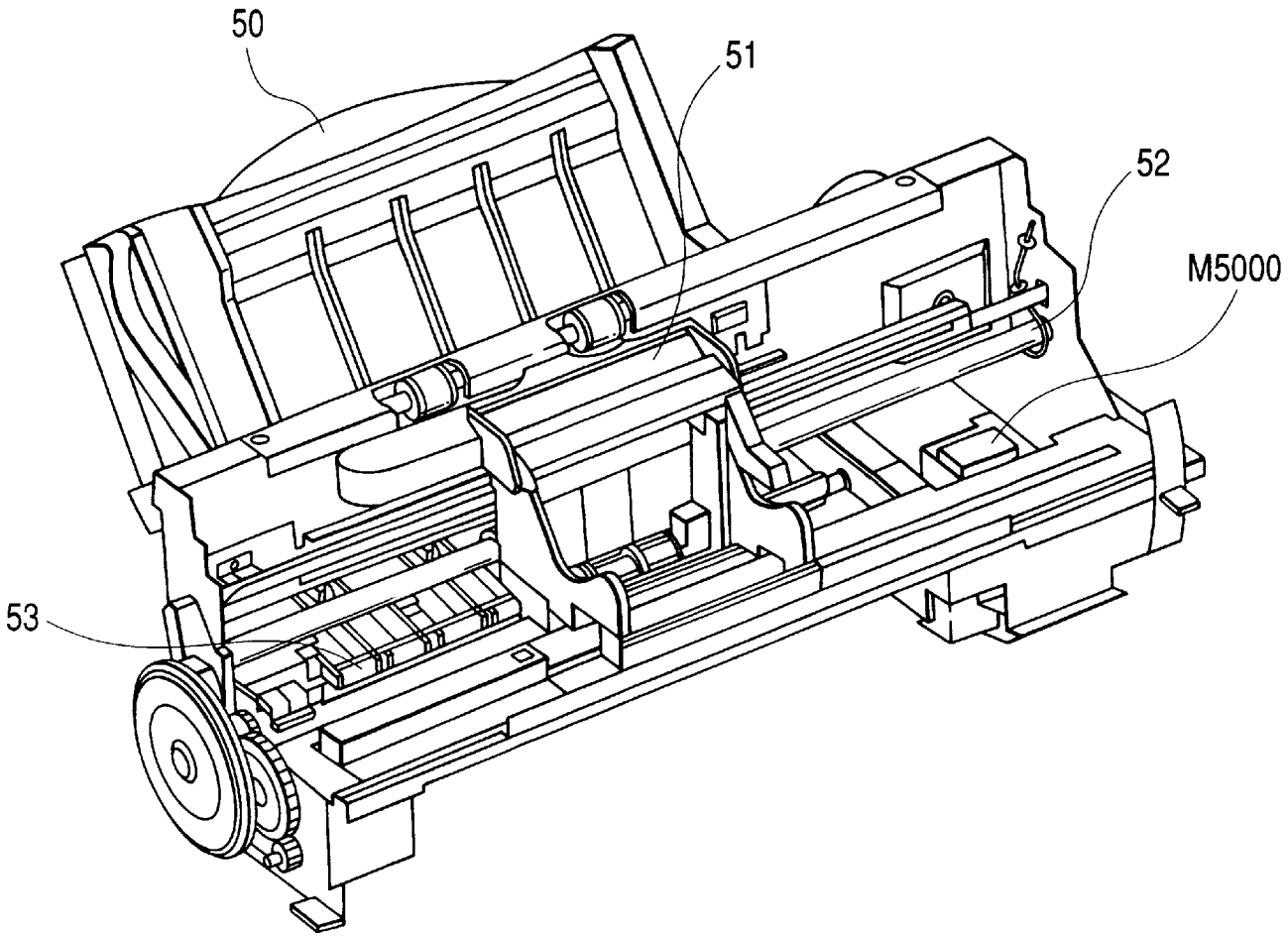
FIG. 7 is a perspective view that shows the principal part of an ink jet recording apparatus having the head cartridge represented in FIG. 6 installed thereon.

FIG. 6 is a view that schematically shows the structure of the head cartridge, and FIG. 5 is a plan view that shows the ink jet recording head unit thereof, observed from the discharge port side. The head cartridge of the present embodiment shown in FIG. 6 and FIG. 5, respectively, is provided with the ink tanks 42*a* to 42*f*, which are installed thereon to retain ink (liquid) of each color of cyan (C), magenta (M), and yellow (Y). These ink tanks 42*a* to 42*f* are connected with the ink jet recording head unit 41 through each of the independent ink supply paths 43.

For the ink jet recording head unit 41, two recording element substrates 10 and 11 are arranged on the supporting member 40, and each color of C, M, Y ink is supplied to each of the recording element substrates 10 and 11, respectively. As described later, on both sides of each of the ink supply ports 3, each one line of discharge port array is arranged zigzag at specific pitches, respectively, for the recording element substrates 10 and 11, thus forming a structure to supply ink of each different color from each of the ink supply ports 3 to the respective nozzle arrays. In other words, to the discharge port arrays 20 to 25, ink is supplied from each of the ink tanks 42*a* to 42*f*, and ink of that color is discharged, respectively. Of the recording element substrates 10 and 11, the recording element substrate 11 is structured to discharge ink droplet in an amount smaller than that of the recording element substrate 10. As a result, the ink jet recording apparatus of the present embodiment is capable of performing gradation recording for the formation of high-quality images.

In a state of being mounted on the carriage 51, the head cartridge is held to enable the discharge port surface of the ink jet recording head unit 41 to face downward in FIG. 7 so that it faces a recording medium to be conveyed. On one end of the path where the carriage 51 reciprocates, there is provided the recovery unit M5000 that performs recovery process in a position that faces the discharge port surface of the ink jet recording head unit 41.

For the recording operation of this ink jet recording apparatus, serial method is adopted. In other words, the conveying unit 53 conveys a recording medium in a specific amount, and the ink jet recording head unit 41 is driven, while the carriage 51 reciprocates, in order to discharge ink selectively at a specific timing, and then, these actions are repeated alternately to perform recording. Also, as the recovery process of this ink jet recording apparatus, wiping to remove foreign substances adhering to the discharge port surface of the ink jet recording head unit 41, and the suction recovery process that sucks out ink from discharge ports are carried out appropriately in order to normalize the ink supply paths 43 from the ink tanks 42 to the recording element substrates 10 and 11 of the ink jet recording head unit 41. The recovery process is carried out in a state where the carriage 51 is moved by the recovery unit M5000 to the position that faces the recovery unit M5000.

Figure 8:
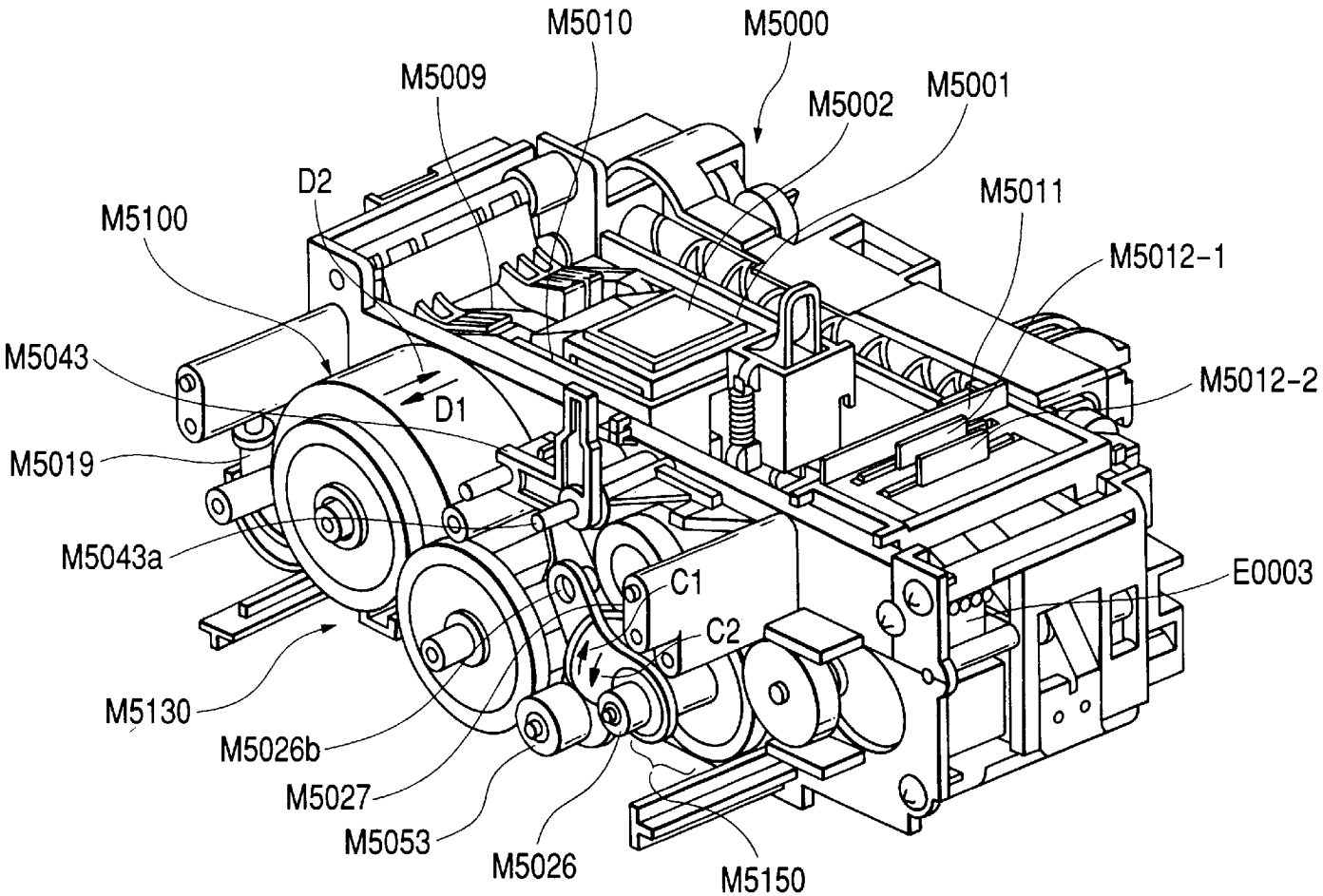
FIG. 8 is a perspective view that shows the recovery unit provided for the ink jet recording apparatus represented in FIG. 7.
Figure 9:
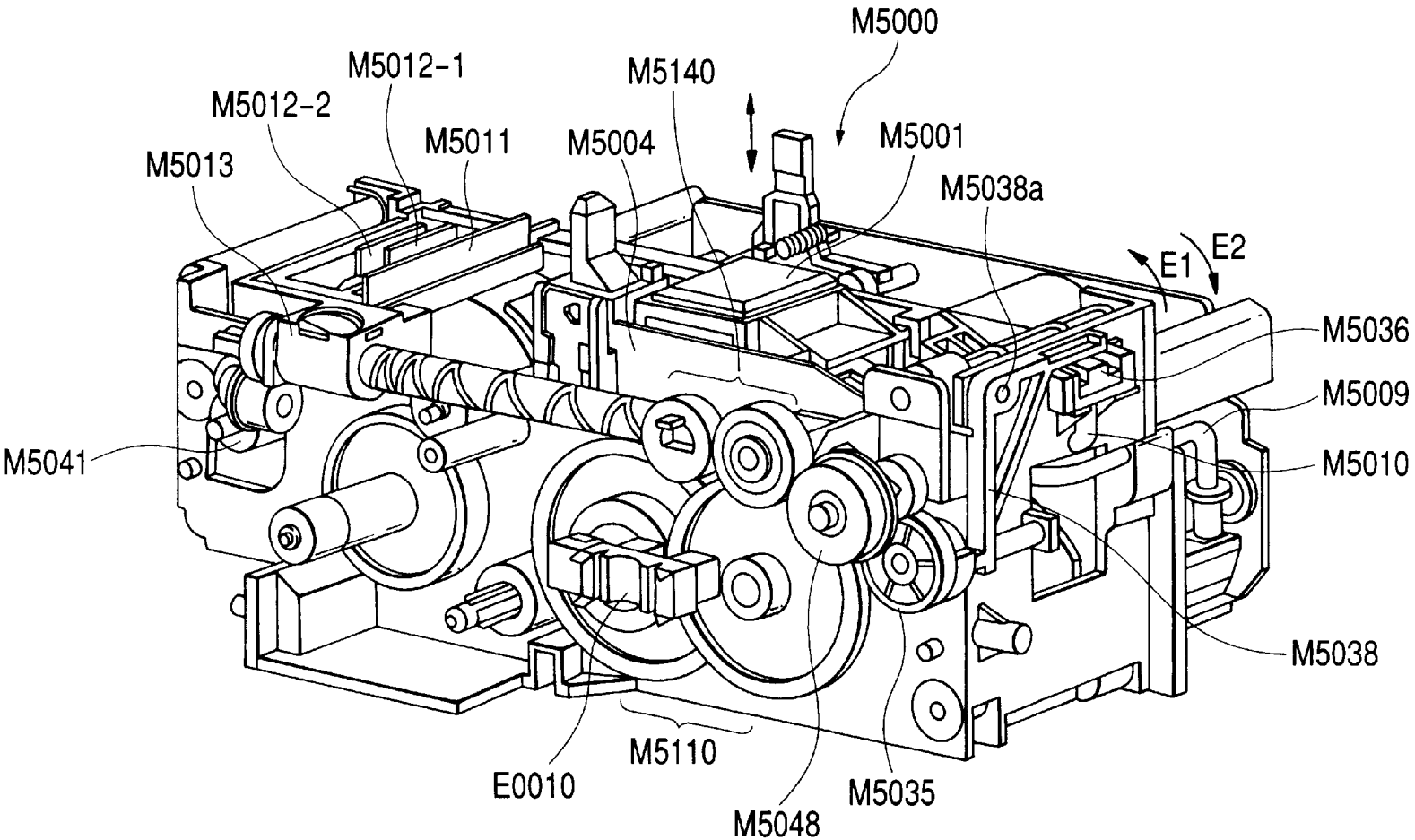
FIG. 9 is a perspective view that shows the recovery unit provided for the ink jet recording apparatus represented in FIG. 7, observed from the side opposite to the side shown in FIG. 8.

Next, with reference to FIG. 8 and FIG. 9, the description will be made of the structure of the recovery unit. In accordance with the present embodiment, the recovery unit M5000 is independent of the ink jet recording apparatus main body, and is structured to be detachably attachable thereto. FIGS. 8 and 9 are perspective views that illustrate the recovery unit M5000 in the detached state, which are observed from the opposite sides to each other, respectively.

The recovery unit M5000 is provided with a wiper blades M5011, M5012-1, and M5012-2 used for wiping when slidably in contact with the discharge port surface of the ink jet recording head unit 41, and the cap M5001, which covers the discharge port surface airtightly for capping. The wiper blades M5011, M5012-1, and M5012-2, and the cap M5001 are formed by rubber material, for example, and in the cap M5001, a cap absorbent M5002 is provided for absorbing ink. The cap absorbent M5002 is arranged so as to face the discharge port surface only with a specific gap at the time of capping.

The cap M5001 is movable supported in up-down directions as indicated by an arrow A in FIG. 9 between the position for capping the discharge port surface and the position away from the discharge port surface. Also, the pump M5100 that effectuates suction is connected with the cap M5001.

These cap M5001, pump M5100, wiper blades M5011, M5012-1, and M5012-2 are driven by a PG motor E0003. Also, the PG motor E0003 is used to drive the automatic feeding unit 50.

More specifically, a cap lever M5004 is fixed to the cap M5001 to enable it to rotate around the axial center, and driving power is transmitted to the cap lever M5004 from one end side of the PG motor E0003 through a one-way clutch M5041, cap driving transmission gear train M5110. Also, driving power is transmitted to the pump M5100 from the other end side of the PG motor E0003 through pendulum driving transmission gear train M5150 and pump driving transmission gear train M5130.

For the cap driving transmission gear train M5100, a PG sensor E0010 is provided to detect the position of the cap M5001. Also, the pendulum transmission gear train M5150 forms drive switching means for changing the transmission paths of driving power between the pump M5100 side and the automatic feeding unit 50 side. In other words, when the PG motor E0003 rotates regularly, the swinging arm M5026 is swung as indicated by arrow C2 in FIG. 9 for the swinging transmission gear train M5150. Then, the switching output gear M5027 engages with the pump gear M5053 positioned on one end of the pump driving transmission gear train M5130 thereby to change driving power of the transmission path to the pump M5100 side. Also, when the PG motor E0003 rotates reversely, the swinging arm M5026 is swung in the direction indicated by an arrow C1 in FIG. 9 to change driving power of the transmission path to the automatic feeding unit 50 side.

In the vicinity of the swinging arm M5026, a switching lever M5043 is provided. The switching lever M5043 is arranged in the position in which it moves in the direction indicated by an arrow D1 by abutting against the carriage 51 when the carriage 51 moves to the capping position where the discharge port surface of the ink jet recording head unit 41 faces the cap M5001. When the switching lever M5043 moves in the direction indicated by the arrow D1 in this manner, the lock pin M5043*a*, which is provided therefor, fits into the lock hole M5026*b*, which is provided for the swinging arm M5026. Then, the pendulum transmission gear train M5150 is locked on the side where driving power is transmitted to the pump M5100 side. Also, when the carriage 51 moves from the capping position, the switching lever M5043 moves to the opposite side indicated by an arrow D2 to release locking.

The pump M5100 is structured to generate pressure by squeezing one end of a pump tube M5019 by use of a pump roller (not shown), which is installed inside the pump. Although the detailed description is omitted, a mechanism is arranged for the pump M5100 to generate contact force of the pump roller to the pump tube M5019 when the PG motor E0003 rotates reversely, and to release it when the PG motor E0003 rotates regularly. Therefore, the pump M5100 is driven to suck the air inside the pump tube M5019 when the PG motor E0003 rotates reversely, hence generating negative pressure.

The other end of the pump tube M5019 is connected with the waste ink absorbent (not shown). On the side of the other end of the pump tube M5019, a cap tube M5009, which is connected with the cap M5001, is also connected.

With the cap M5001, there is connected the valve tube M5010, which is connected with the valve rubber M5036 that forms a valve mechanism together with the valve lever M5038, besides the cap tube M5009 connected to the pump M5100 side. The valve lever M5038 rotates around the shaft M5038*a* in the directions indicated by arrows E1 and E2 in FIG. 9, thus being supported to be able to abut against or part from the valve rubber M5036. When the valve lever M5038 rotates in the direction E2 to abut against the valve rubber M5036, the valve mechanism thus structured is in the closed condition. When the valve lever M5038 rotates in the direction E1 to part from the valve rubber M5036, the valve mechanism is in the open condition, hence releasing the valve clutch tube M5010 to the air outside. The valve lever M5038 is interlocked with an exhaust roller through the valve clutch M5048 and the valve driving transmission gear train M5140, and when the exhaust roller rotates regularly, it rotates in the direction E2, and when the exhaust roller rotates reversely, it rotates in the direction E1.

Next, the description will be made of the recovery process by use of the recovery unit M5100.

For the execution of the recovery process, the PG motor E0003 rotates regularly at first before the carriage 51 moves to the capping position. Then, the swinging arm M5026 is swung in the direction indicated by the arrow C2 to change driving power of the transmission path to the pump M5100 side. After that, the carriage M4001 moves to the capping position. Then, the switching lever M5043 moves in the direction indicated by the arrow D1, and the swinging arm M5026 is locked in a state where driving power of the transmission path is locked in the state of being changed to the pump M5100 side.

Next, the exhaust roller rotates reversely to rotate the valve lever M5038 in the direction indicated by the arrow E1, thus releasing the end portion of the valve tube M5010 to the air outside. In this state, the driving power generated by the regular rotation of the PG motor E0003 is transmitted to the wiper blades M5011, M5012-1, and M5012-2 for wiping. Also, it is transmitted to the cap M5001 for capping. The edge of the cap M5001 abuts against the circumferential area (see FIG. 5) of the portion of the supporting member 40 of the ink jet recording head unit 41 where recording element substrates 10 and 11 are arranged, and covers the discharge port surface airtightly.

At this juncture, since the PG motor E0003 rotates regularly, the pump roller is not pressed to the pump tube M5019. Therefore, negative pressure is not generated.

Next, the exhaust roller rotates regularly, and then, the valve lever M5038 rotates in the direction indicated by the arrow E2 to close the end portion of the valve tube M5010, and in this state, the PG motor E0003 rotates reversely. Thus, the pump roller is pressed to the pump tube M5019 and driven to squeeze the pump tube M5019 in order to generate negative pressure. The negative pressure thus generated acts on inside the cap M5001, which airtightly closes the discharge port surface of the ink jet recording head unit 41 through the pump tube M5009. As a result, inside the cap M5001 is also negatively pressurized. Then, ink is sucked out form the discharge ports, and the ink that becomes unsuitable for recording, bubbles, and the like are sucked out together forcefully for removal. Ink thus sucked out is received by the cap absorbent M5002.

After that, suction is made during a specific period of time, and then, while the PG motor E0003 is kept in the state of reverse rotation, the sheet expeller roller M2003 rotates reversely. Thus, the valve lever M5038 rotates in the direction indicated by the arrow E1 to release the end portion of the valve tube M5010 to the air outside. As a result, inside the cap M5001, the cap tube M5009, and the pump tube M5019 is made atmospheric pressure with the air outside thus induced, and the forcible suction operation for the discharge ports is suspended. At this juncture, ink filled in the pump tube M5019, cap tube M5009, and cap M5001 flow along with the induction of the air outside to be exhausted to the waste ink absorbent from the other end of the pump tube M5019 on the side opposite to the pump M5100 side. Ink inside the cap M5001 is then absorbed by the cap absorbent M5002 and exhausted completely.

Lastly, the PG motor E0003 is suspended. Also, the sheet expeller roller M2003 rotates regularly to enable the valve lever M5038 to rotate in the direction indicated by the arrow E2, thus closing the end portion of the valve tube M5010 in order to keep inside the cap M5001 in the airtightly closed condition. With these operations, the recovery process terminates.

Figure 1A:
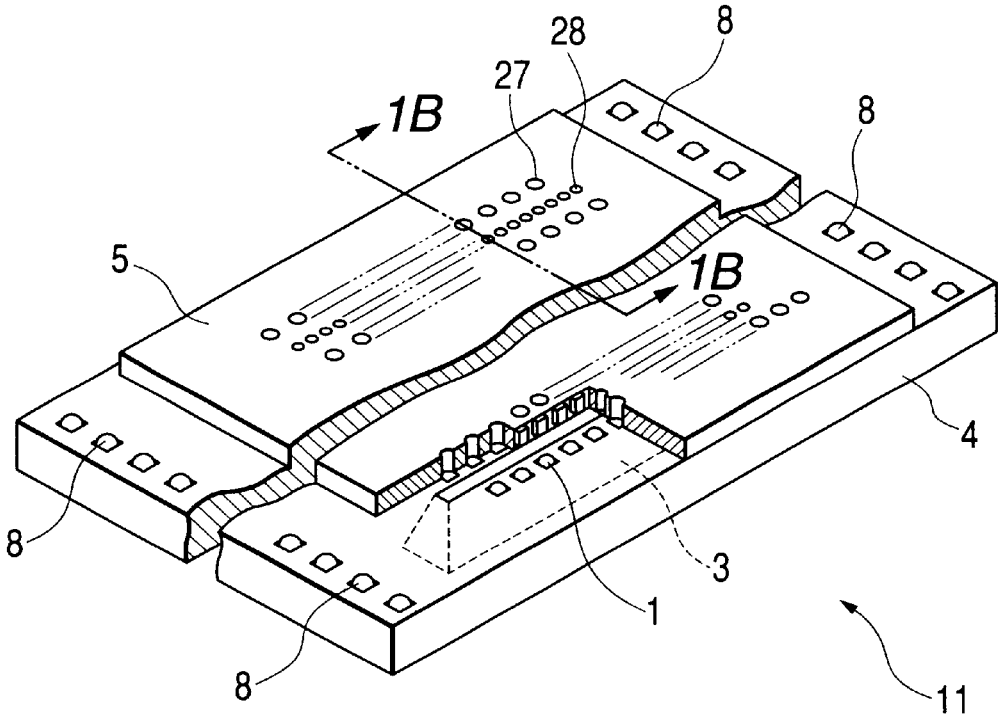
FIGS. 1A and 1B are views that schematically illustrate the recording element substrate for discharging ink droplet in a comparatively small amount in accordance with a first embodiment of the present invention.
Figure 1B:
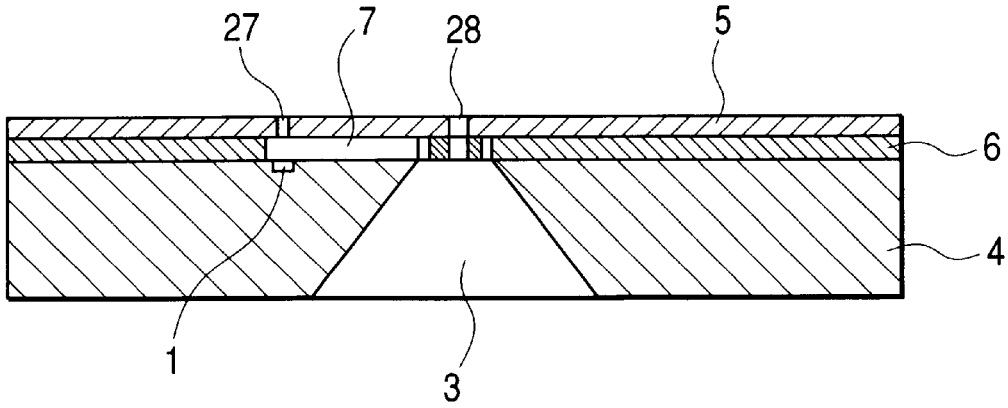
Figure 2A:
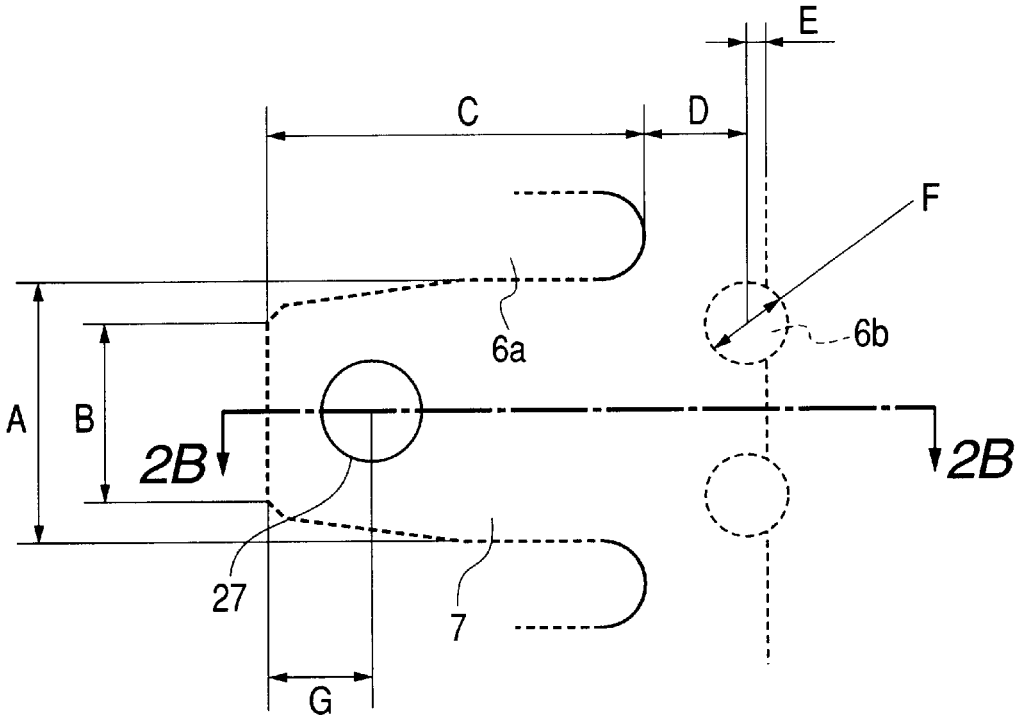
FIGS. 2A and 2B are views that schematically illustrate the nozzle portion of the recording element substrate shown in FIGS. 1A and 1B.
Figure 2B:
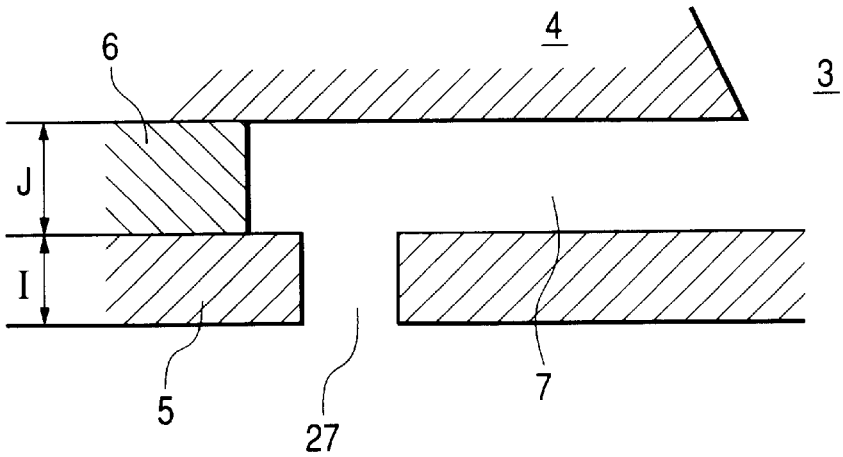
Figure 3A:
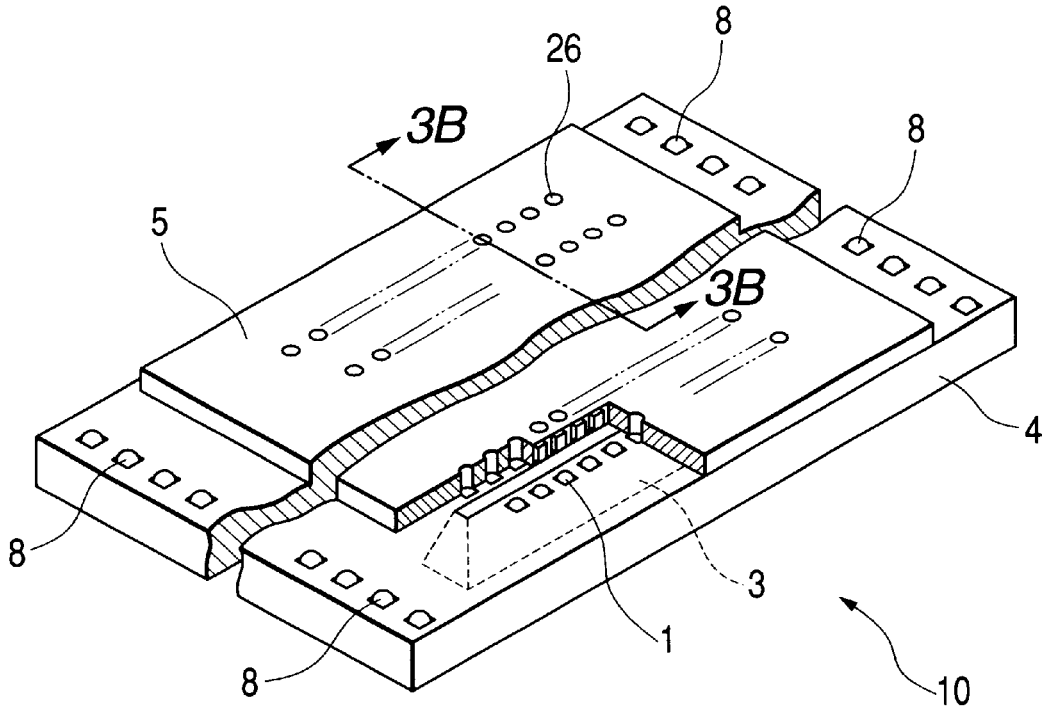
FIGS. 3A and 3B are views that schematically illustrate the recording element substrate for discharging ink droplet in a comparatively large amount in accordance with the first embodiment of the present invention.
Figure 3B:
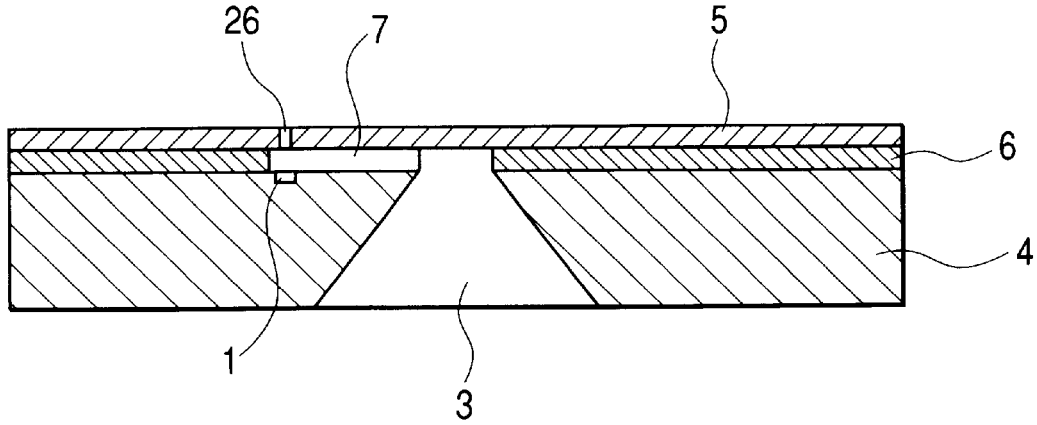

Next, with reference to FIGS. 1A, 1B, 2A, 2B, 3A, 3B, 4A and 4B, the description will be made of the structure of the recording element substrates 10 and 11 further in detail. FIGS. 1A and 1B, and FIGS. 2A and 2B illustrate the recording element substrate 11 that discharges ink droplets in a small discharge amount. FIG. 1A is a partly broken perspective view, and FIG. 1B is a cross-sectional view taken along line 1B—1B in FIG. 1A. FIG. 2A is a plan view that shows one nozzle portion. FIG. 2B is a cross-sectional view taken along line 2B—2B in FIG. 2A. Also, FIGS. 3A and 3B, and FIGS. 4A and 4B are views that illustrate likewise the recording element substrate 10 that discharges ink droplets in a large discharge amount.

The recording element substrate 10 shown in FIGS. 3A and 3B, and FIGS. 4A and 4B is provided with a substrate 4 having the electrothermal converting element 1 formed therefor. For the substrate 4, there are arranged to be open the two ink supply ports 3 formed with penetrated openings of elongated groove type, the longitudinal axes of which are in parallel to each other. Each electrothermal converting member 1 is arranged side by side at a specific pitch on both sides along the longitudinal axes of the ink supply ports 3. The arrangement of the electrothermal converting members 1 on both sides is such as to shift them by half pitch, respectively. Therefore, the electrothermal converting members 1 are arranged zigzag at specific pitches as the entire body formed by them on both sides together. Also, on the substrate 4, electrode terminals 8 are formed and connected with the recording apparatus main body side. Also, electric wiring (not shown) is formed to connect the electrode terminals 8 with the electrothermal converting members 1.

Figure 4A:
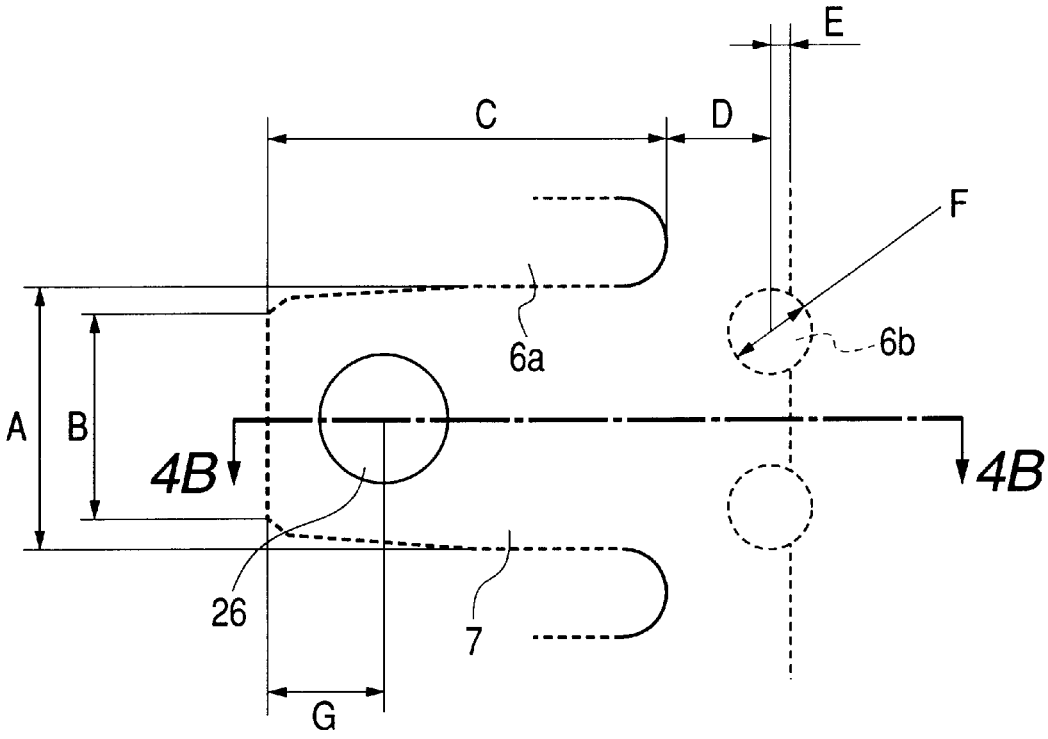
FIGS. 4A and 4B are views that schematically illustrate the nozzle portion of the recording element substrate shown in FIGS. 3A and 3B.
Figure 4B:
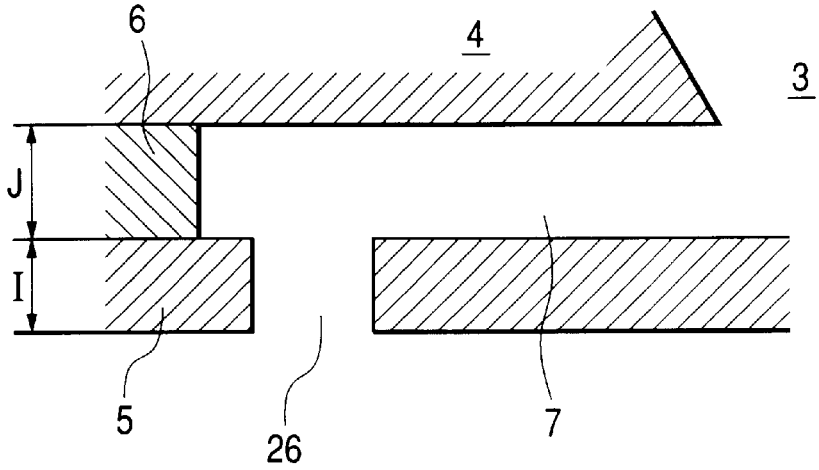

On the substrate 4, there is further arranged the ink flow path formation member 6, which is formed by the common liquid chamber positioned above the ink supply ports 3, and each ink flow path (liquid flow path) 7 communicated with each of the electrothermal converting members 1. In other words, as shown in FIG. 4A, the ink flow path formation member 6 forms flow path walls 6*a* to partition each of the ink flow paths 7. Also, the ink flow path formation member 6 forms two columnar portions 6*b* near the entrance from the common liquid chamber to the ink flow path 7. The columnar portions 6*b* function as filters or the like in order not to allow foreign substances to enter the ink flow path 7.

On the ink flow path formation member 6, there is arranged a discharge port plate 5 on which the discharge ports 26 are open. The discharge ports 26 correspond one to one to each of the electrothermal converting members 1, which are open to each position facing each of the electrothermal converting members, respectively. Therefore, the discharge ports 26 form two lines of the discharge port arrays, which are zigzagged at specific pitches. The discharge ports 27, ink flow paths 7, and electrothermal converting members 1 form the discharge unit that discharges ink.

In this respect, it is possible to form the substrate 4 with glass, ceramics, plastics, metal, or the like if only the substrate is made capable of functioning as one member that constitutes ink flow paths, and also, functioning as a supporting member for the electrothermal converting members 1, the ink flow path formation member 6, and the discharge port plate 5. Here, most preferably, Si substrate is used. Also, the ink flow path formation member 6 and the discharge port plate 5 may be formed integrally as a nozzle formation member 9 (see FIG. 12, for example) as described in a second embodiment of the present invention.

Next, the structures of the substrate 4, ink flow path formation member 6, discharge port plate 5, and others of the recording element substrate 11 shown in FIGS. 1A and 1B and FIGS. 2A and 2B are almost the same as those of the recording element substrate 10 shown in FIGS. 3A and 3B and FIGS. 4A and 4B. In each of these figures, the same reference numerals are applied to the corresponding parts of the recording element substrate 10 and recording element substrate 11 for convenience' sake. However, as described earlier, the recording element substrate 11 is structured to discharge ink droplets in a smaller discharge amount than that of the recording element substrate 10. Therefore, the output of the electrothermal converting member 1 and the dimension of the ink flow path 7 may be adjusted accordingly. Particularly, in accordance with the present embodiment, the discharge port 27 is made smaller than the discharge port 26.

The recording element substrate 11 that has the small discharge port 27 thus arranged is different from the recording element substrate 10 that has the large discharge port 26 in the aspect that the discharge port plate 5 of the former is provided with the openings 28 that do not discharge liquid droplet. In accordance with the present embodiment, each of the openings 28 is arranged on each of the intersecting points of the center line extending in the longitudinally axial direction of each ink supply port 3 and the extended line of the center line of each ink flow path 7, which extends in the direction of ink supply.

Next, the description will be made of the suction recovery process capability of the ink jet recording head unit 41 having the recording element substrates 10 and 11 arranged therefor.

Figure 21:
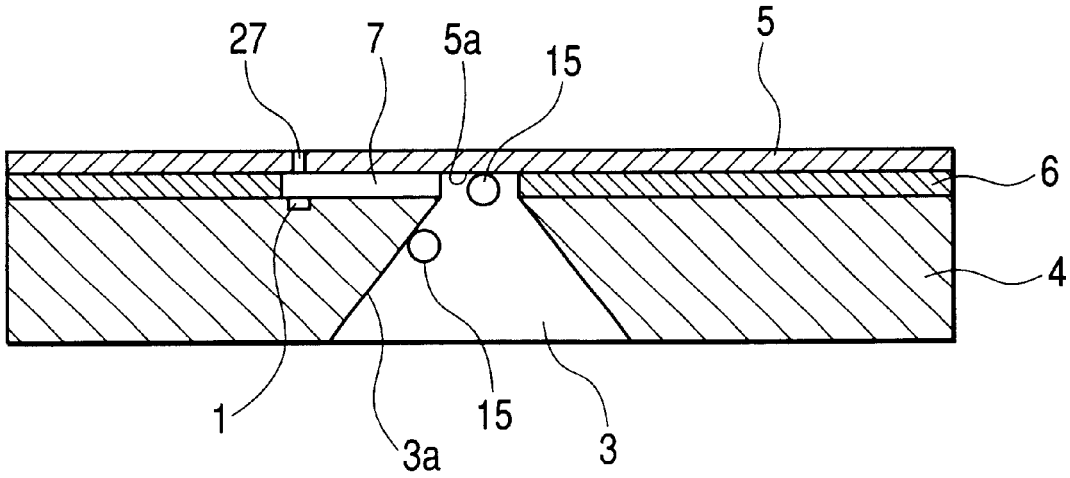
FIG. 21 is a cross-sectional view that shows the condition of bubble remainders in the recording element substrate.

Based on the precise studies made by the inventors hereof, bubbles 15 created in the recording element substrate are often retained on the side walls 3*a* of the ink supply port 3 or the backside 5*a* of the discharge port plate 5 as shown in FIG. 21 due to the air that enters form the fitting portions of the discharge ports 26 and 27, and the ink supply path 43 of the recording element plate shown in FIG. 1A to FIG. 4B. Therefore, when the bubbles 15 are removed by means of the suction recovery process, it is conceivably required to enable ink to flow in the ink supply port 3 portion at faster flow rate to a certain extent. Particularly, it is considered effective to make the ink flow rate faster on the side walls 3*a* of the ink supply port 3 and the backside 5*a* of the discharge port plate 5.

As described above, in accordance with the present embodiment, the openings 28 are provided for the recording element substrate 11 having the small discharge ports 27. Thus, the flow resistance becomes smaller when the suction recovery process is executed for the recording element substrate 11. As a result, even for the recording element substrate 11 that has small discharge ports 27, it is possible to make the flow rate faster for ink flowing in the ink supply ports 3 at the time of executing the suction recovery process, and the suction recovery process can be executed in good condition with the removal of bubbles 15.

Also, with the provision of the openings 28 on the recording element substrate 11 side, which has small discharge ports 27, the flow resistance in the recording element substrate 11 is made closer to the flow resistance in the recording element substrate 10 when the suction recovery process is executed. As a result, even by use of the cap M5001, which caps the recording element substrate 11 having the small discharge ports 27 and the recording element substrate 10 having the large discharge ports 26 together, for the suction recovery process essentially under the same condition (suction pressure, suction time) for both of them, the process can be executed appropriately for both them. In other words, it is made possible to prevent ink from being sucked in an amount more than necessary with respect to the recording element substrate 10 that has large discharge ports 26, while preventing any insufficient suction of bubbles and overly viscous ink from the small discharge ports 27 provided for the recording element substrate 11.

Next, with respect to the structure of the present embodiment, the example will be shown, in which a suction recovery process is specifically executed.

The recording element substrate 10 is formed to discharge an ink droplet of 4 pl, and the recording element substrate 11 is formed to discharge an ink droplet of 2 pl. For the discharge port arrays 20, 21, 22, 23, 24, and 25, there are arranged for any one of them 256 discharge ports at pitches of 600 DPI (42 $\mu$m interval) on one side of each ink supply port 3. Therefore, 512 discharge ports are arranged at pitches of 1,200 DPI (21 $\mu$m interval) in total on both sides each. The distance between centers of discharge port on both side, which is observed in the direction at right angles to the longitudinal axes of the ink supply port 3, that is, the distance between the centers of electrothermal converting members 1 on both sides, is 215 μm. Also, each width of the openings of the ink supply ports 3 on both sides where the electrothermal converting members 1 are formed is 115 μm. Also, the sectional area of each ink supply path 43, which is provided individually for each of the aforesaid discharge port arrays 20, 21, 22, 23, 24, and 25 from each ink tank 42 to the ink jet recording unit 41, is ϕ 1 mm. Here, the ink, viscosity of which is 2.2 CP at a temperature of 25° C., is used.

For the recording element substrate 10 that discharges ink droplets in a large discharge amount, the discharge port area is ϕ 15.5 μm, and the height of the ink flow path 7 (at a reference mark J in FIG. 4B) is 14.0 μm. The height from the electrothermal converting member 1 to the surface of the discharge port plate 5 (I+J in FIG. 4B) is 25.0 μm. The electrothermal converting member 1 is in a form of square of 24 μm long per side. Also, as shown in FIG. 4A, the ink flow path 7 is in such a form that it becomes narrower slightly on the way toward the depth side. The width A of the wider portion near the entrance is 32 μm, and the width of the leading end B is 24 μm. The length of the ink flow path, that is, the length C form the end portion at the depth side thereof to the leading end of the flow path wall 6*a* is 48.5 μm. The distance D in the direction of the inflow path 7 from that end to the center of the column portion 6*b* is 12.8 μm, and further, the distance E from that center to the edge of the ink supply port 3 is 4.7 μm. The diameter F of the column portion 6*b* is 10 μm. Also, the distance G from the end portion of the ink flow path 7 on the depth side to the center of the discharge port 26 is 14 μm.

For the recording element substrate 11 that discharges ink droplets in a small discharge amount, on the other hand, the discharge port area is ϕ 11.0 μm, and the height of the ink flow path (at a reference mark J in FIG. 2B) is 14.0 μm. The height from the electrothermal converting member 1 to the surface of the discharge port plate 5 (I+J in FIG. 2B) is 25.0 μm. The electrothermal converting member 1 is in a form of square of 22 μm long per side. Also, as shown in FIG. 2A, the ink flow path 7 is in the same of the recording element substrate 10. The dimension of part is arranged: A is 32 μm; B, 22 μm; C, 47.5 μm; D, 12.8 μm; E, 4.7 μm; F, 10 μm; and G, 13 μm.

It is preferable to make the opening 28 smaller than the discharge port 27 in order to avoid the dust particles that may enter the ink supply port 3 from outside the ink jet recording head unit 41. In accordance with this example, the opening is ϕ 10 μm, and each of them is arranged for discharge ports 27 one to one. Also, the opening 28 is arranged on the central portion of each ink supply port 3 as described earlier, and the distance between the center of each discharge port 27, that is the center of each electrothermal converting member 1, and the center of corresponding opening 28 is 107.5 μm.

Here, in accordance with the studies made by the inventors hereof, it is preferable to make the arrangement of the distance between the centers of the opening 28 and the discharge port 27/the height from the surface of the electrothermal converting member 1 to the surface of the discharge port plate 5>1 in order not to allow ink to be discharged from the opening 28 when ink droplet is discharged from the discharge port 27 after ink is bubbled by use of the electrothermal converting member 1. Therefore, in accordance with this example, the opening 28 is arranged to be away from the discharge port 27 with a sufficient distance in order to satisfy the aforesaid relations.

With the structure described in the above example, the suction recovery process is performed. Then, it is confirmed that bubbles are removed in good condition from both the discharge portion that discharges ink in a large discharge amount and the discharge portion that discharges in a small discharge amount.

Here, for the structure of the present embodiment, the opening 28 is provided, and ink is evaporated from such opening to make the atmospheric moisture comparatively high in the vicinity of the small discharge port 27. As a result, it becomes possible to reduce the opportunity that ink becomes overly viscous in the small discharge port portion 27. Thus, the effect that the viscous plug phenomenon can be reduced is also made obtainable.

Also, in accordance with the present embodiment, the structure is shown to arrange the opening 28 in the center of the ink supply port 3. However, the arrangement position of the opening 28 is not necessarily limited to this structure. It should be good enough if only the opening is arranged in the projection area of the ink supply port to the opening surface of the small discharge port 27. For example, the opening 28 may be positioned nearer to the edge side of the opening on the surface side of the ink supply port 3 where the electrothermal converting member 1 is formed. With the structure thus arranged, it becomes easier to generate the flow on the sidewalls of the ink supply port 3 on the ink flow path 7 side. Therefore, this structure is preferable, because, conceivably, bubbles adhering to this portion, that is, bubbles residing in the portion nearer to the ink flow path 7 can be removed in a better condition.

Also, for the present embodiment, the description has been made of the structure in which the opening 28 is individually provided for the small discharge port 27, but if the opening 28 is directly communicated with the ink supply port 3, the structure is not necessarily limited thereto. It should be good enough if only setting is made in accordance with various conditions.

Also, the provision of the opening 28 for the position of the kind is effective for the structure in which the ink supply port that supplies ink to the small discharge port and the ink supply port that supplies ink to the large discharge port are separately provided for one recording element substrate.

Also, for the present embodiment, the description has been made of the structure in which the discharge port 27 is made smaller than the discharge port 26. In order to change the discharge amount of ink droplet, it is conceivable to provide a structure in which the output of the electrothermal converting member 1 changes, besides the size of the discharge port changes. In any case, it is usually practiced to arrange the structure so that the discharge portion that discharges ink droplets in a small discharge amount has a large flow resistance than that of the discharge portion that discharges ink droplets in a large discharge amount. Therefore, the structure of the present embodiment is generally effective for an ink jet recording head that contains the discharge portion that discharges ink droplets in a different discharge amount. Also, for the present embodiment, the structure that uses the electrothermal converting member as recording element to generate energy whereby to discharge ink droplets has been shown, but the structure of the present embodiment is equally effective for the ink jet recording, which is structured by use of piezoelectric element. These are the same for the embodiments to be described hereunder.

Also, the present invention is effective for the ink jet recording head that contains the discharge portion for discharging ink droplets in a small discharge amount. Therefore, it is particularly preferable to apply the invention to the ink jet recording head of atmospheric communication type, which is capable of discharging ink droplets stably in a small discharge amount. This is the same for the embodiments to be described hereunder. As described earlier, the discharge plate of the ink jet recording head of atmospheric communication type should be formed extremely thin in some cases. When the invention is applied to an ink jet recording head of the kind, the suction recovery process is made executable for the discharge portion for discharging ink droplet in a small discharge amount in good condition without increasing the suction pressure or prolonging the suction period, hence making it possible to obtain the effect of reducing unfavorable influence to be exerted on the discharge port plate by the performance of suction recovery process.

(Second Embodiment)

Figure 10:
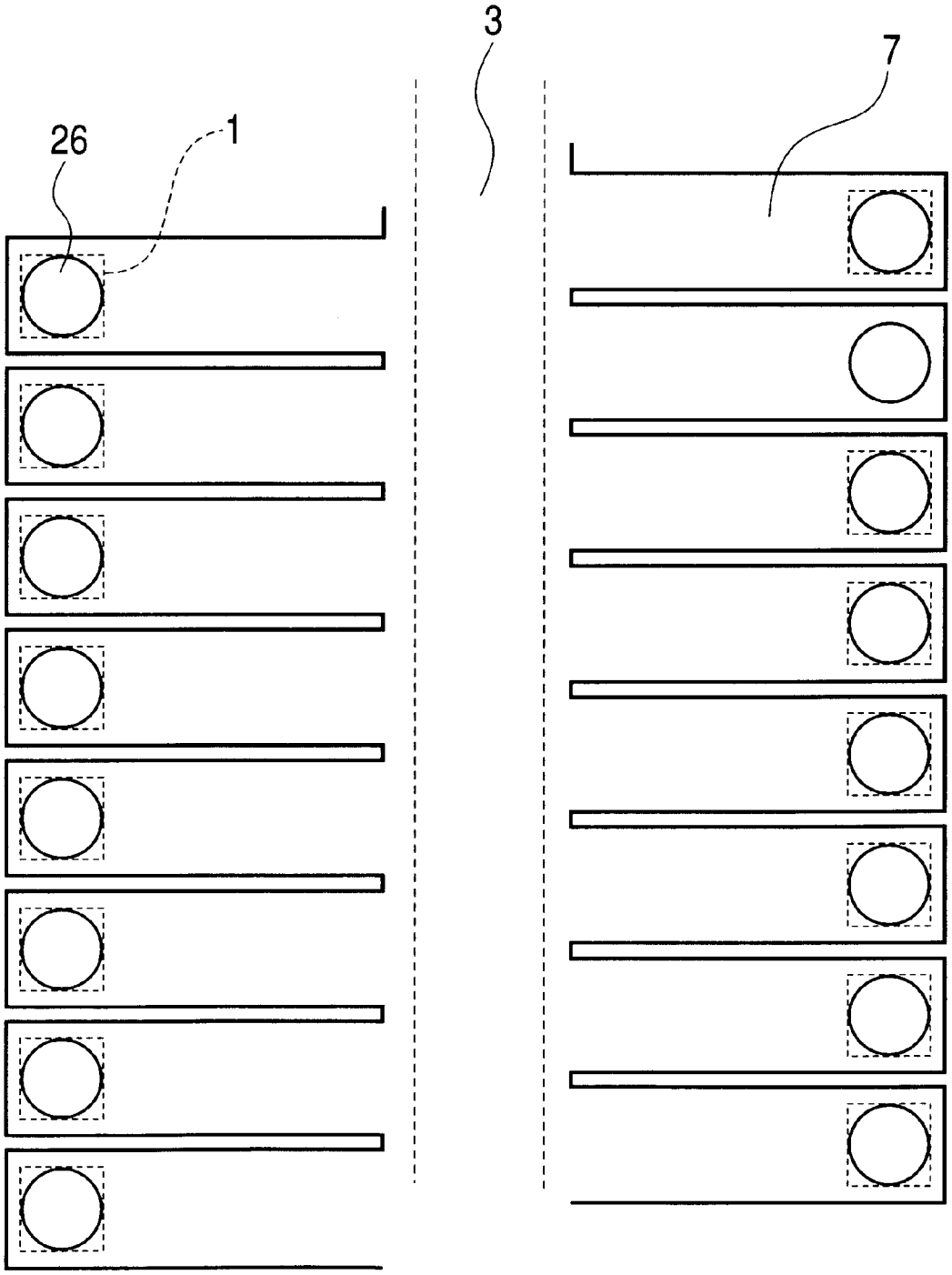
FIG. 10 is a plan view that shows a recording element substrate for discharging ink droplets in a comparatively large discharge amount in accordance with a second embodiment of the present invention.
Figure 11:
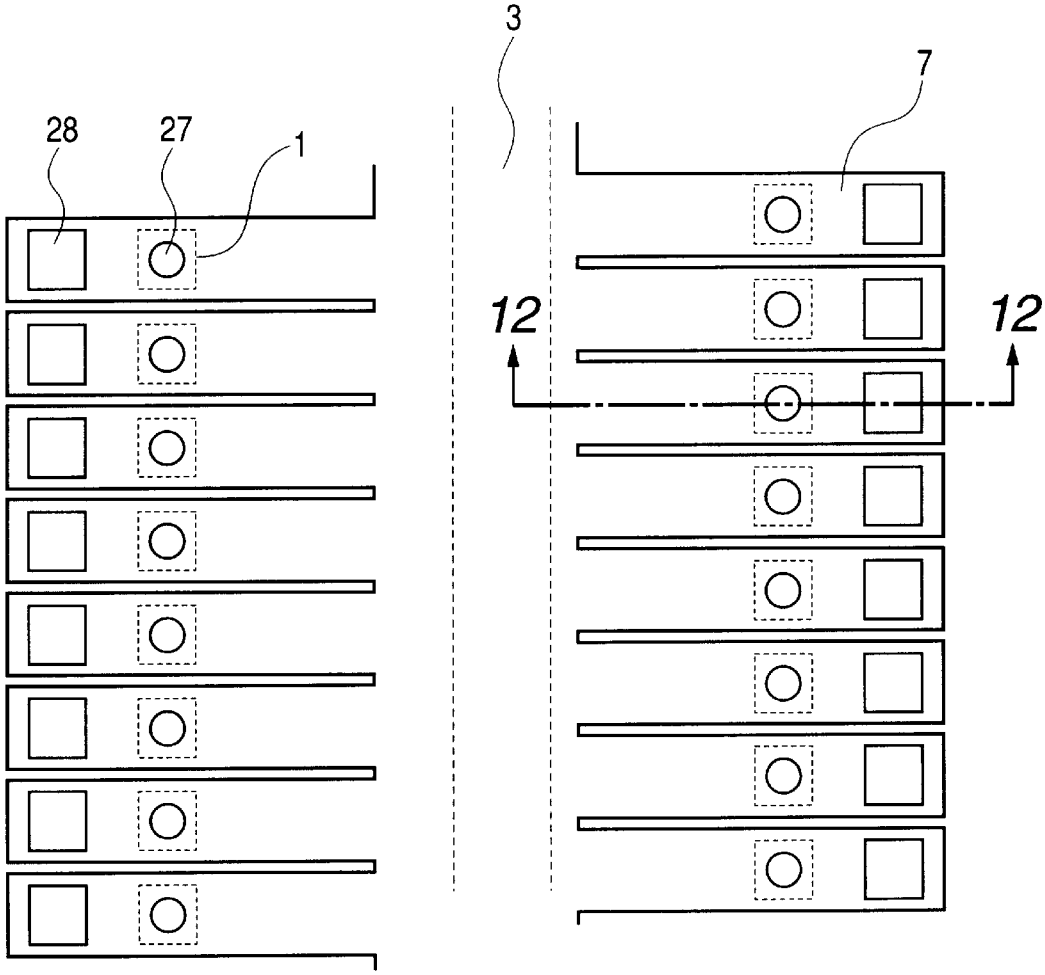
FIG. 11 is a plan view that shows a recording element substrate for discharging ink droplets in a comparatively small discharge amount in accordance with a second embodiment of the present invention.
Figure 12:
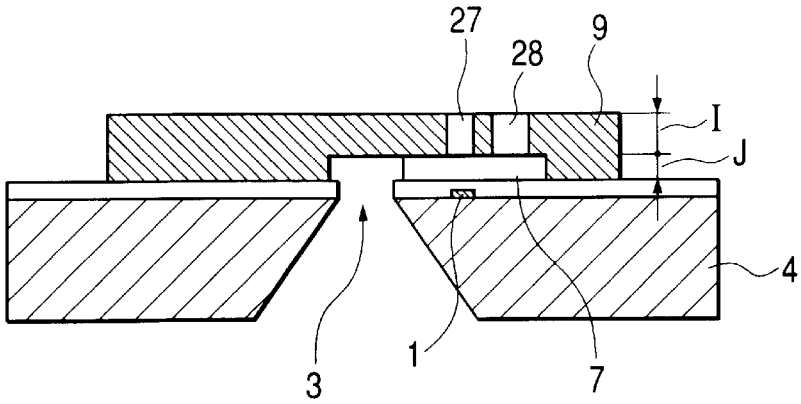
FIG. 12 is a cross-sectional view taken along line 12—12 in FIG. 11.

Next, with reference to FIG. 10 to FIG. 12, the description will be made of a second embodiment in accordance with the present invention. For the present embodiment, the structure of the ink jet recording apparatus as a whole is the same as that of the first embodiment. Therefore, the detailed description thereof will be omitted. FIG. 10 and FIG. 11 are plan views that illustrate, respectively, the recording element substrate 10 for discharging ink droplets in a large discharge amount, and the recording element substrate 11 for discharging ink droplets in a small discharge amount, which are observed from the discharge port surface side. For FIGS. 10 and 11, the ink flow path 7, ink supply port 3, and electrothermal converting member 1 are represented perspectively. FIG. 12 is a cross-sectional view taken along line 12—12 in FIG. 11. In FIGS. 10 to 12, the same reference marks are applied to the same parts having the same functions as those of the first embodiment for convenience' sake.

In accordance with the present embodiment, the opening 28 is arranged on the deeper side of the ink flow path 7 than the discharge port 27 for the recording element substrate 11 for discharging ink droplets in a small discharge amount. With the structure thus arranged, it becomes possible to remove more effectively bubbles and overly viscous ink residing in the ink flow path 7 having the small discharge port 27 provided therefor by enabling ink to flow in that portion when the suction recovery process is executed. The size of the small discharge port 27 is extremely small in particular for the structure of the present embodiment, and in a case where no opening 28 is provided, and ink in the ink flow path 7 cannot easily flow, this structural arrangement is effectively applicable at the time of executing the suction recovery process.

Also, for the structure of the present embodiment, the opening 28 is positioned further away from the ink supply port 3 as compared with the first embodiment. Therefore, it is preferable to make the opening comparatively large in order to generate a sufficiently fast flow rate in the ink supply port 3. The size of the opening 28 should preferably be larger than that of the large discharge port 26 even in the discharge portion that discharges ink droplets in a small discharge amount, in particular, so as to obtain the suction recovery capability equal to that of the discharge portion that discharges ink droplets in a large discharge amount.

Next, with respect to the structure of the present embodiment, the example will be shown, in which a suction recovery process is specifically executed.

The recording element substrate 10 is formed to discharge an ink droplet of 4 pl, and the recording element substrate 11 is formed to discharge an ink droplet of 2 pl. For the discharge port arrays 20, 21, 22, 23, 24, and 25, there are arranged for any one of them 256 discharge ports at pitches of 600 DPI (42 $\mu$m interval) on one side of each ink supply port 3. Therefore, 512 discharge ports are arranged at pitches of 1,200 DPI (21 $\mu$m interval) in total on both sides each. The distance between centers of discharge port on both side, which is observed in the direction at right angles to the longitudinal axes of the ink supply port 3, that is, the distance between the centers of electrothermal converting members 1 on both sides, is 215 $\mu$m. Also, each width of the openings of the ink supply ports 3 on both sides where the electrothermal converting members 1 are formed is 115 $\mu$m. Also, the sectional area of each ink supply path 43 from each ink tank 42 to the ink jet recording head unit 41 is $\phi$ 1 mm. Here, the ink, viscosity of which is 2.2 CP at a temperature of 25° C., is used.

For the recording element substrate 10 that discharges ink droplets in a large discharge amount, the discharge port area is $\phi$ 15.5 $\mu$m, and the height of the ink flow path 7 (at a reference mark J in FIG. 12) is 14.0 $\mu$m. The height from the electrothermal converting member 1 to the surface of the discharge port plate 5 (I+J in FIG. 12) is 25.0 $\mu$m. The electrothermal converting member 1 is in a form of square of 24 $\mu$m long per side.

For the recording element substrate 11 that discharges ink droplets in a small discharge amount, on the other hand, the discharge port area is $\phi$ 10.0 $\mu$m, and the height of the ink flow path (at a reference mark J in FIG. 12) is 14.0 $\mu$m. The height from the electrothermal converting member 1 to the surface of the discharge port plate 5 (I+J in FIG. 12) is 25.0 $\mu$m. The electrothermal converting member 1 is in a form of square of 22 $\mu$m long per side.

The size of the opening 28 is 16 $\mu$m×16 $\mu$m, and it is provided for each of the discharge ports 27 one to one. As described earlier, in order not to allow ink from being discharged from the opening 28 when the electrothermal converting member 1 is driven, it is preferable to make the distance between the center of the opening 28 and that of the discharge port 27 larger than the height from the surface of the electrothermal converting member 1 to the discharge port surface. For the present example, this center-to-center distance is 30 $\mu$m.

With the structure described in the above example, the suction recovery process is performed. Then, it is confirmed that bubbles are removed in good condition from both the discharge portion that discharges ink in a large discharge amount and the discharge portion that discharges in a small discharge amount.

Also, in accordance with the present embodiment, it is possible to obtain the preventive effect against the viscous plug phenomenon as in the case of the first embodiment.

Figure 13:
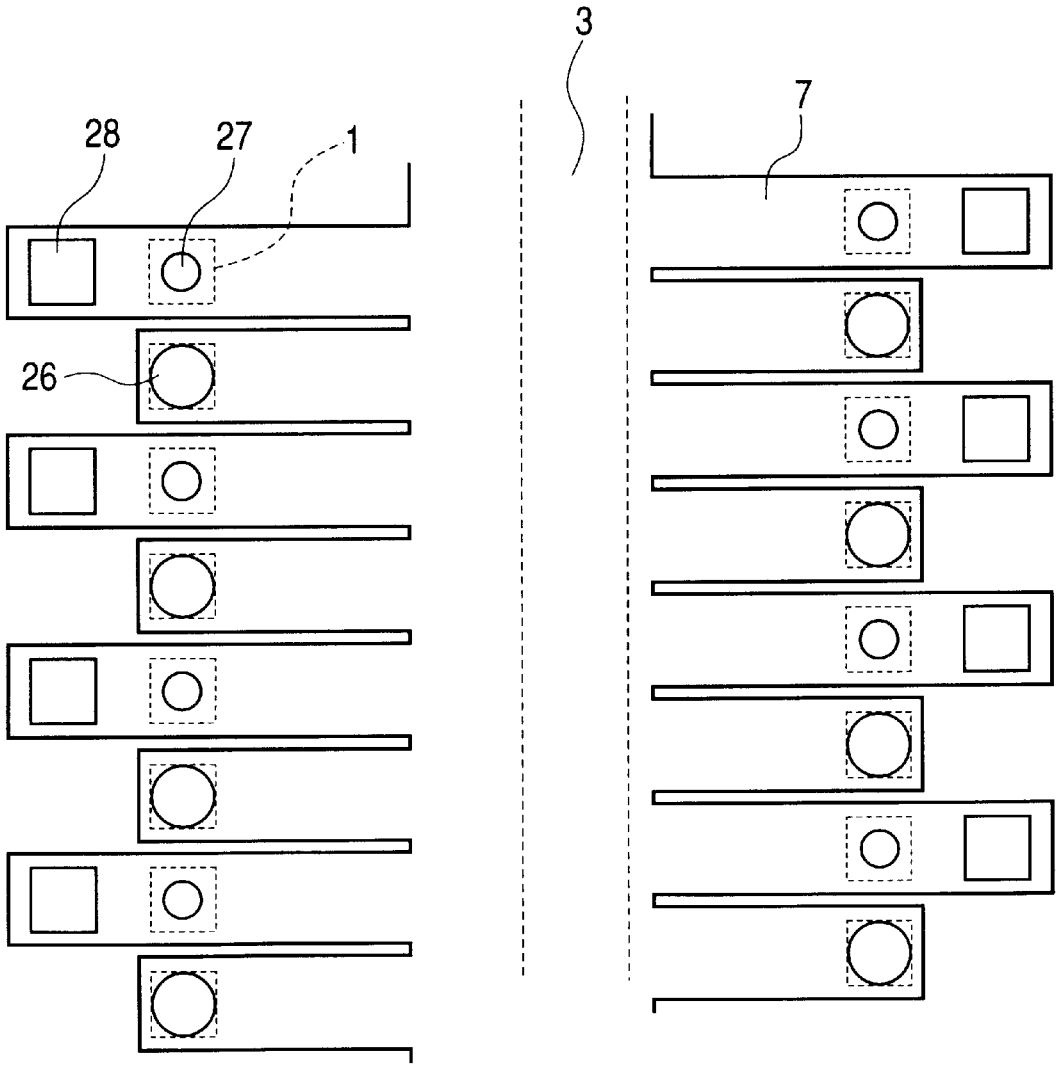
FIG. 13 is a plan view that shows the variational example of the recording element substrate in accordance the second embodiment of the present invention.
Figure 14:
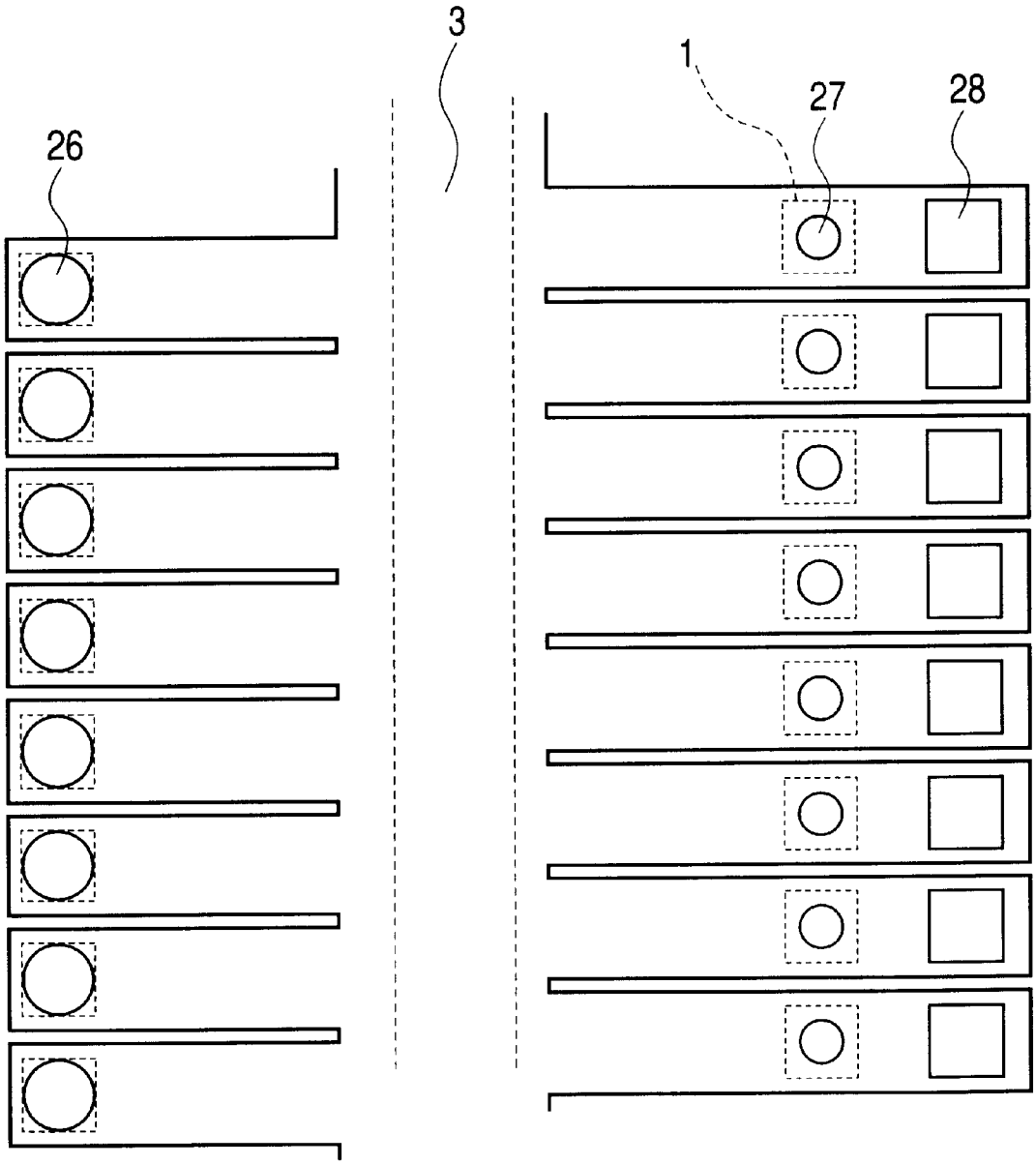
FIG. 14 is a plan view that shows another variational example of the recording element substrate in accordance with the second embodiment of the present invention.

Also, for the present embodiment, the example is shown, in which the small discharge port 27 and the large discharge port 26 form separate discharge port arrays, respectively. However, the present embodiment is effective for the structure in which the small discharge port 27 and the large discharge port 26 are provided for one discharge port array, too. This is the same for the first embodiment, and the embodiments to be described hereinafter. FIG. 13 and FIG. 14 are plan views that illustrate structural examples of the recording element substrates, which are observed from the discharge port surface side.

For the structure shown in FIG. 13, the small discharge ports 27 and the large discharge ports 26 are arranged alternately in the order of arrangement thereof along the array of the ink supply ports 3 on one side. When observing the zigzagged supply port arrays, that is, the entire body formed by getting the discharge ports, which are arranged on both sides of the ink supply ports 3, together, the small discharge ports 27 and large discharge ports 26 are arranged alternately by two in the order of the arrangement thereof. On the other hand, for the structure shown in FIG. 14, the small discharge ports 27 and the large discharge ports 26 are arranged on one side of the ink supply ports 3, respectively. Therefore, When observing the zigzagged supply port arrays, that is, the entire body formed by getting the discharge ports, which are arranged on both sides of the ink supply ports 3, together, the small discharge ports 27 and large discharge ports 26 are arranged alternately in the order of the arrangement thereof. The arrangement of the small discharge ports 27 and the large discharge ports 26 are not necessarily limited to this one. Another arrangement may be adoptable.

Even for the structure of the kind, it is made possible to enable ink to flow in the ink flow path 7 provided for the small discharge port 27 equally to the ink flow in the ink flow path 7 provided for the large discharge port 26 at the time of executing the suction recovery process with the arrangement of the opening 28, which is positioned on the deeper side of the ink flow path 7 where the small discharge port 27 is provided. Therefore, it is made possible to execute the suction recovery process in good condition even for the ink flow path 7 where the small discharge port 27 is provided.

Also, in the ink flow path 7 where the opening 28 is provided, capillary force is generated in the opening 28 at the time of refilling, that is, when ink is filled again subsequent to having discharged ink droplet. Therefore, it becomes possible to obtain the action that makes the speed of ink refilling to that extent. Consequently, in the discharge portion that discharges ink in a small discharge amount, refilling can be executed promptly even in the structure where the ink flow path 7 is made narrower in order to increase the flow resistance.

Also, for the ink jet recording head structured in accordance with the present embodiment, plural discharge ports are arranged comparatively closer, and connected by way of the common liquid chamber. With the structure thus arranged, when ink droplet is discharged from on discharge portion, there may be the case where the vibrations generated along the ink discharge and ink refill exert slight influences upon ink in the discharge ports nearby. Conceivably, such influence may appear as vibrations of comparatively larger meniscus of the small discharge port particularly when ink droplet is discharged from the large discharge port. However, in accordance with the structure of the present embodiment, when vibrations are propagated to ink residing near the small discharge port 27, the vibrations of the meniscus are generated at the opening 28 arranged comparatively closer thereto. In other words, the vibrations of ink are dispersed into those of the meniscus in the discharge port 27 and the meniscus at the opening 28. As a result, an action is obtainable to minimize the vibrations of meniscus in the discharge port 27. Thus, the structure of the present embodiment makes it possible to obtain the effect that the stabilization of ink discharges is enhanced.

(Third Embodiment)

Figure 15A:
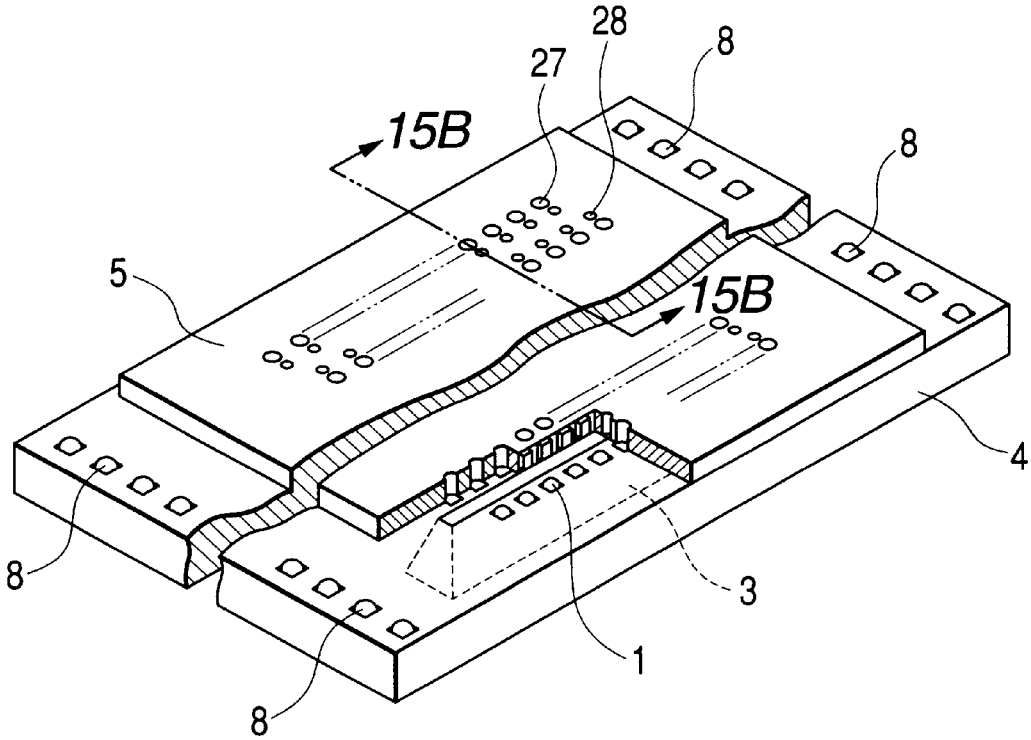
FIGS. 15A and 15B are views that schematically illustrate the recording element substrate for discharging ink droplets in a comparatively small discharge amount.
Figure 15B:
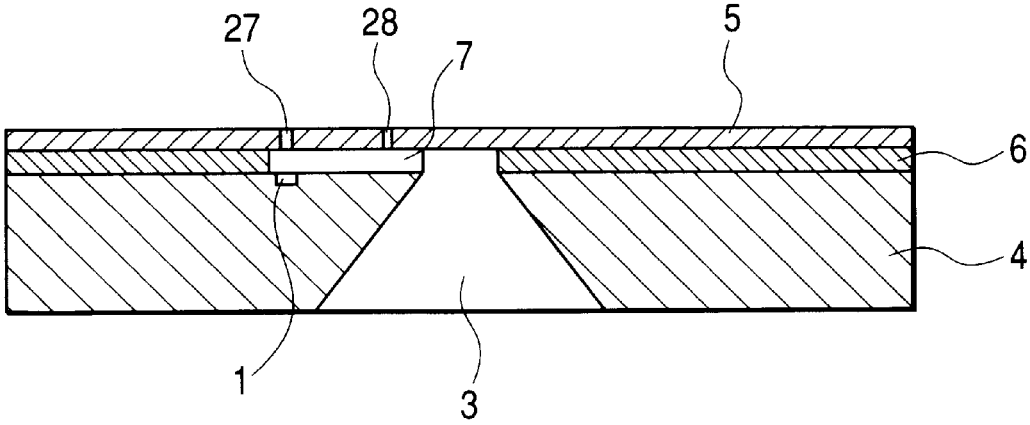
Figure 16A:
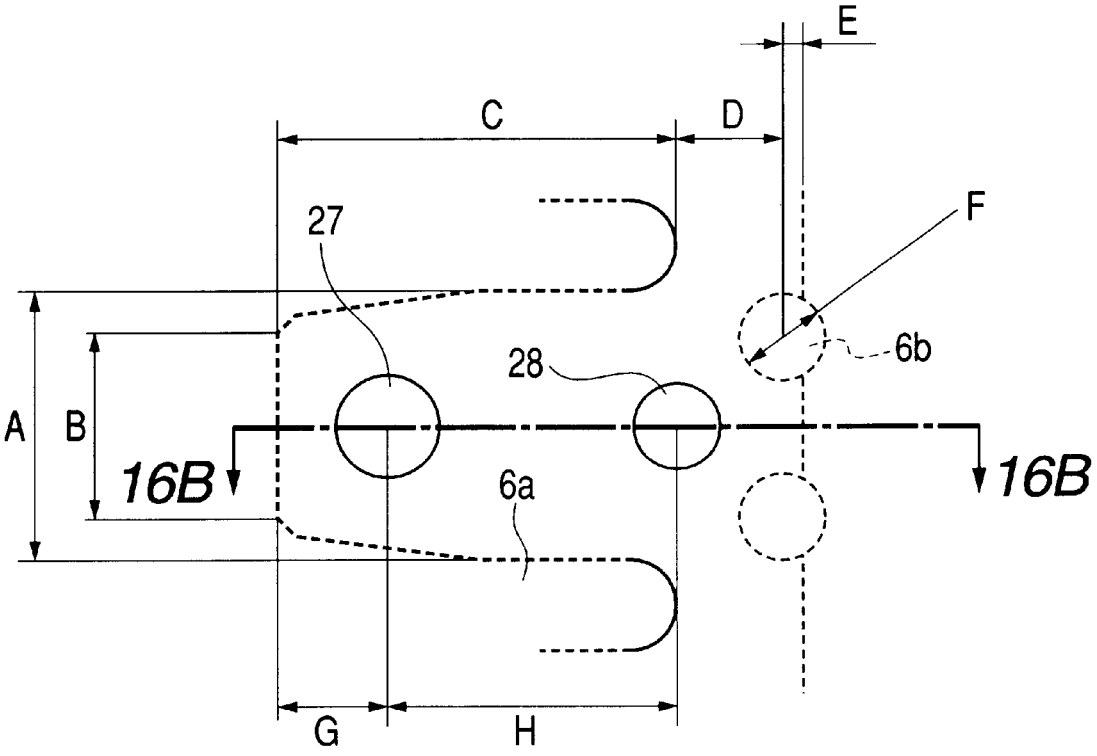
FIGS. 16A and 16B are views that schematically illustrate the nozzle portion of the recording element substrate represented in FIGS. 15A and 15B.
Figure 16B:
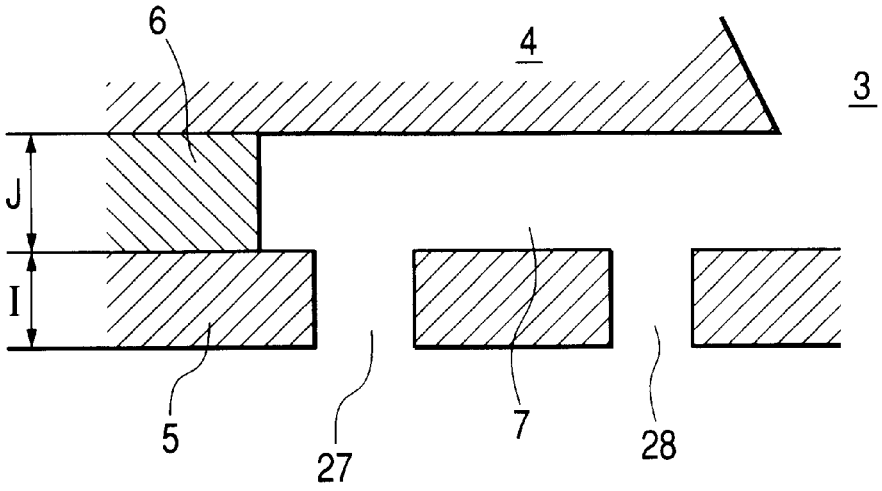

Next, with reference to FIGS. 15A and 15B, and FIGS. 16A and 16B, the description will be made of a third embodiment in accordance with the present invention. For the present embodiment, the entire structure of the ink jet recording apparatus is the same as those of the first and second embodiments. Therefore, the detailed description thereof will be omitted. FIGS. 15A and 15B are views that schematically illustrate the recording element substrate 10 that discharges ink droplets in a small discharge amount. FIG. 15A is a partially broken perspective view. FIG. 15B is a cross-sectional view taken along line 15B—15B in FIG. 15A. FIGS. 16A and 16B are views that schematically illustrate the nozzle portion of the recording element substrate 10 shown in FIGS. 15A and 15B, that is, schematically illustrates the discharge portion. FIG. 16A is a plane view, and FIG. 16B is a cross-sectional view taken along line 16B—16B in FIG. 16A. In FIGS. 15A to 16B, the same reference marks are applied to the same parts having the same functions as those of the first and second embodiments for convenience' sake.

For the structure of the present embodiment, the opening 28 is arranged more on the discharge port 27 side than the edge of the opening of the ink supply port 3 on the surface side where the electrothermal converting member 1 is provided. The center of the opening 28 is positioned on the central line of the ink flow path 7 that extends in the ink supply direction. In accordance with this structure, the opening 28 is arranged comparatively closer to the ink supply port 3. As a result, when the suction recovery process is executed, it becomes possible to generate a comparatively fast flow rate on the sidewalls of the ink supply port 3 and the backside of the discharge port plate 5. Furthermore, since the opening 28 is arranged more on the discharge port 27 side than the ink supply port 3, it is possible to generate a comparatively fast flow rate in the ink flow path 7 at the time of executing the suction recovery process.

In this respect, although found by the studies of the inventors hereof, the structure of the present embodiment may sometimes present a case where the ink refilling to the discharge port 27 and the removal of bubbles residing in the ink flow path 7 on the deeper side than the opening 28 are insufficient if the amount of ink suction from the opening 28 is too large when the suction recovery process is executed. Therefore, it is preferable to make the size of the opening 28 smaller than that of the discharge port 27. Then, ink can be refilled in the ink flow path sufficiently, and bubbles in the ink flow path 7 can be removed sufficiently, too, hence making it possible to execute the suction recovery process in good condition.

Also, at the time of executing the suction recovery process, it is conceivable that ink exhausted into the cap M5001 is slightly mixed in the ink flow path 7 from the opening 28 temporarily in some cases. In this case, since the structure of the present embodiment is such that six discharge port arrays, which discharge ink of different colors, respectively, are covered by one cap M5001, ink having a mixture of six colors is mixed eventually. Ink thus mixed is mostly sucked out again during the suction recovery process, but if such ink thus mixed should be dispersed in ink, there is considered a possibility that recorded images are affected, which is not desirable. Therefore, in accordance with the present embodiment, the opening 28 is positioned more on the discharge port 27 side than the ink supply port 3, thus providing it on the area where the height of the flow path is lower. As a result, even if such ink thus sucked should be mixed, it is made possible to suppress the mixed ink to be dispersed into ink.

Next, with respect to the structure of the present embodiment, the example will be shown, in which a suction recovery process is specifically executed.

The recording element substrate 10 is formed to discharge an ink droplet of 4 pl, and the recording element substrate 11 is formed to discharge an ink droplet of 2 pl. For the discharge port arrays 20, 21, 22, 23, 24, and 25, there are arranged for any one of them 256 discharge ports at pitches of 600 DPI (42 $\mu$m interval) on one side of each ink supply port 3. Therefore, 512 discharge ports are arranged at pitches of 1,200 DPI (21 μm interval) in total on both sides each. The distance between centers of discharge port on both side, which is observed in the direction at right angles to the longitudinal axes of the ink supply port 3, that is, the distance between the centers of electrothermal converting members 1 on both sides, is 215 μm. Also, each width of the openings of the ink supply ports 3 on both sides where the electrothermal converting members 1 are formed is 115 μm. Also, the sectional area of each ink supply path 43 from each ink tank 42 to the ink jet recording head unit 41 is ϕ 1 mm. Here, the ink, viscosity of which is 2.2 CP at a temperature of 25° C., is used.

For the recording element substrate 10 that discharges ink droplets in a large discharge amount, the discharge port area is ϕ 15.5 μm, and the height of the ink flow path 7 (at a reference mark J in FIG. 16B) is 14.0 μm. The height from the electrothermal converting member 1 to the surface of the discharge port plate 5 (I+J in FIG. 16B) is 25.0 μm. The electrothermal converting member 1 is in a form of square of 24 μm long per side. Also, for the equally structured-ink flow path 7 shown in FIG. 16A, the dimension of each part is: A is 32 μm; B, 24 μm; C, 48.5 μm; D, 12.8 μm; E, 4.7 μm; F, 10 μm; and G, 14 μm.

For the recording element substrate 11 that discharges ink droplets in a small discharge amount, on the other hand, the discharge port area is ϕ 11.0 μm, and the height of the ink flow path (at a reference mark J in FIG. 16B) is 14.0 μm. The height from the electrothermal converting member 1 to the surface of the discharge port plate 5 (I+J in FIG. 16B) is 25.0 μm. The electrothermal converting member 1 is in a form of square of 22 μm long per side. Also, for the ink flow path 7 structured as shown in FIG. 16A, the dimension of each part is: A is 32 μm; B, 22 μm; C, 47.5 μm; D, 12.8 μm; E, 4.7 μm; F, 10 μm; and G, 14 μm.

The size of the opening 28 is ϕ 10 μm. As described earlier, in order not to allow ink from being discharged from the opening 28 when the electrothermal converting member 1 is driven, it is preferable to make the distance between the center of the opening 28 and that of the discharge port 27 larger than the height from the surface of the electrothermal converting member 1 to the discharge port surface. For the present example, this center-to-center distance H is 47.8 μm.

With the structural example thus provided, the suction recovery process is executed. Then, it is confirmed that bubbles are removed in good condition both in the discharge portion that discharges ink droplets in a large discharge amount and in the discharge portion that discharge ink droplets in a small discharge amount.

Here, in accordance with the present embodiment, it is possible to obtain the viscous plug phenomenon preventive effect as in the cases of the first and second embodiments. Also, as in the second embodiment, it is possible to obtain the action that enhances the discharge stability of ink droplets, as well as the capability of prompt refilling.

Figure 17:
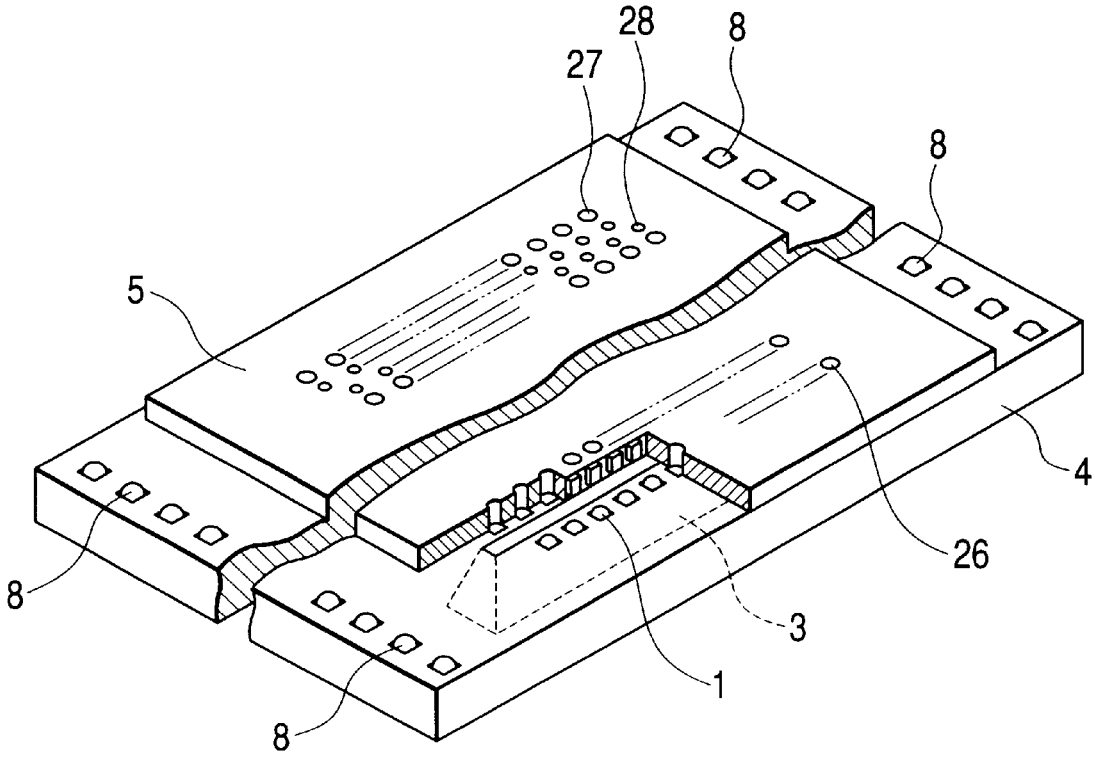
FIG. 17 is a perspective view that shows the variational example of the recording element substrate in accordance with a third embodiment of the present invention.
Figure 18A:
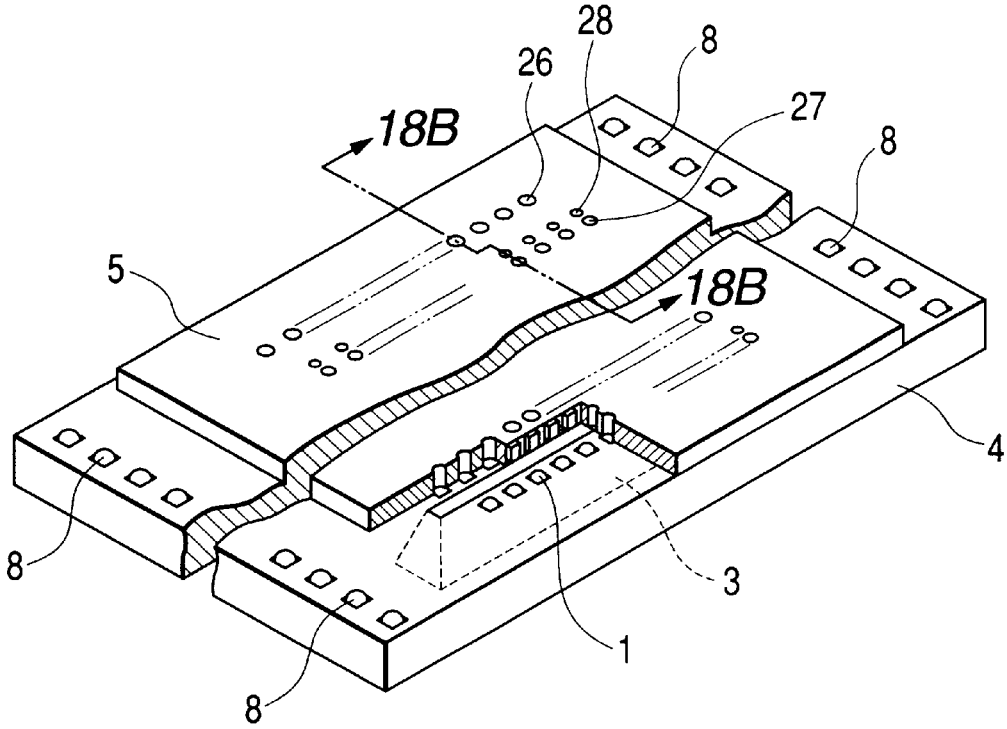
FIGS. 18A and 18B are vies that schematically illustrate another variational example of the recording element substrate in accordance with the third embodiment of the present invention.
Figure 18B:
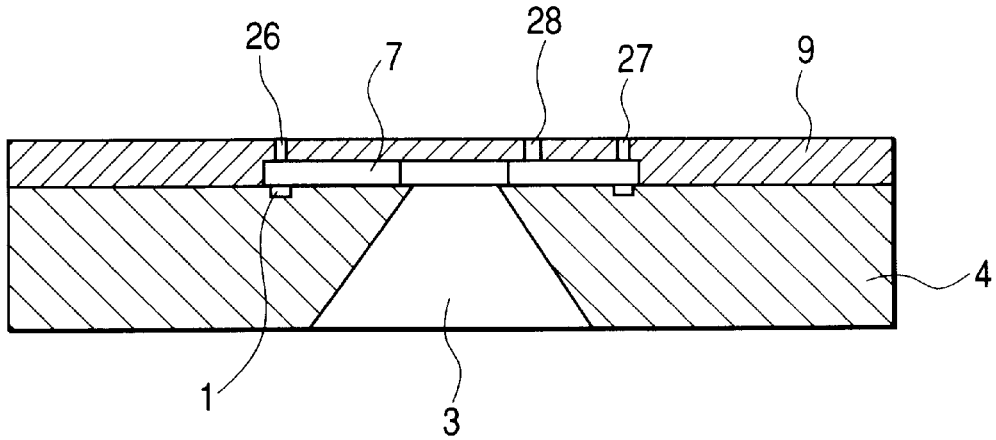

Also, the present embodiment is effective for the structure that the small discharge port 27 and the large discharge port 26 are provided for one recording element substrate as shown in FIG. 17, and FIGS. 18A and 18B. The recording element substrate shown in FIG. 17 is structured to provide one recording element substrate with the ink supply port for supplying ink to the small discharge port and the ink supply port for supplying ink to the large discharge port separately. Also, the recording element substrate shown in FIGS. 18A and 18B is structured so as to supply ink form one ink supply port to the small discharge port and the large discharge port, respectively. As described above, with the arrangement of opening 28 only in the vicinity of the ink flow path 7 for which the small discharge port 27 is provided, the flow resistance in the ink flow path 7 provided with the small discharge port 27 is made smaller to make its difference with the flow path 7 provided with the large discharge port 26 smaller accordingly in order to equalize the flow rates at the time of executing the suction recovery process, hence making it possible to perform the suction recovery process in good condition.

(Fourth Embodiment)

Figure 19A:
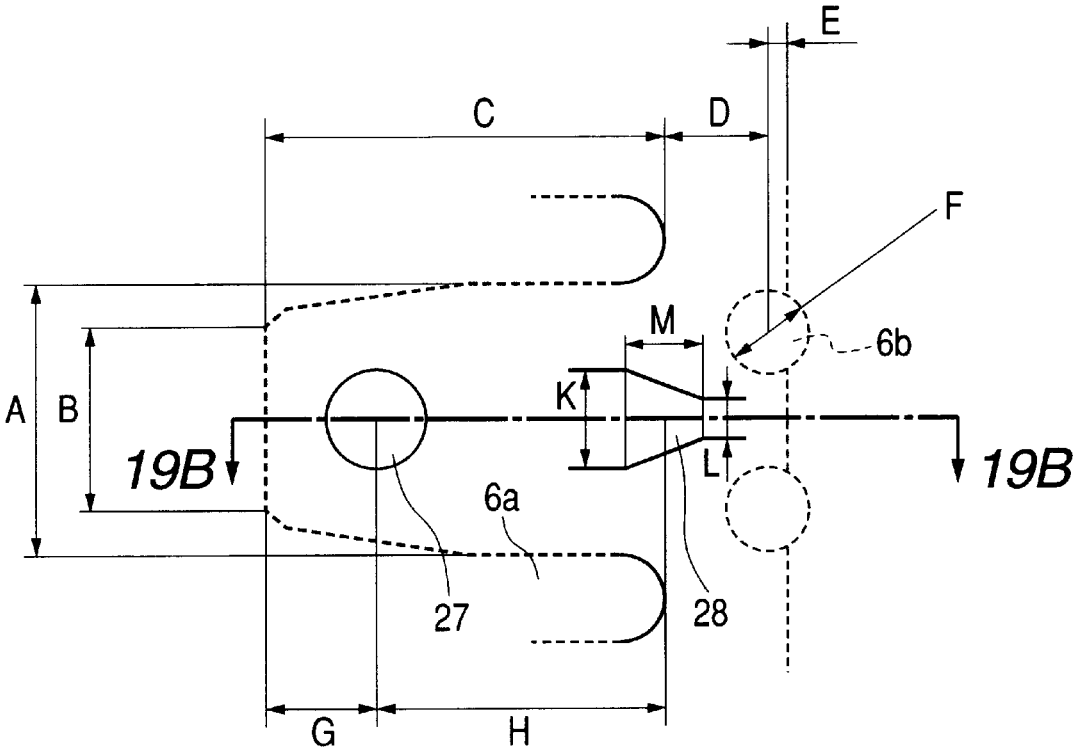
FIGS. 19A and 19B are views that schematically illustrate the nozzle portion of the recording element substrate for discharging ink droplet in a comparatively small discharge amount.
Figure 19B:
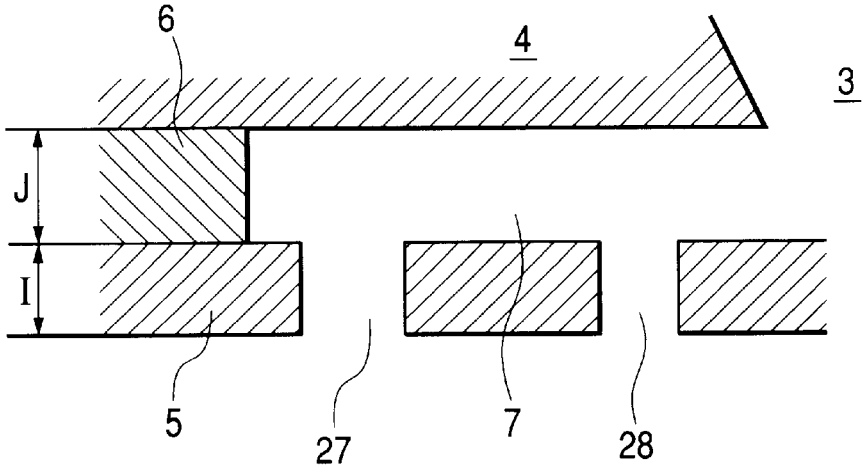

Next, with reference to FIGS. 19A and 19B, the description will be made of a fourth embodiment in accordance with the present invention. For the present embodiment, the entire structure of the ink jet recording apparatus is the same as those of the first to third embodiments. Therefore, the detailed description thereof will be omitted. FIGS. 19A and 19B are views that schematically illustrate the recording element substrate that discharges ink droplets in a small discharge amount. FIG. 19A is a plane view, and FIG. 19B is a cross-sectional view taken along line 19B—19B in FIG. 19A.

For the present embodiment, the opening 28 is arranged more on the discharge port 27 side than the edge of the opening on the surface side where the electrothermal converting member 1 is provided as in the third embodiment. The center of the opening 28 is positioned on the central line of the ink flow path 7 that extends in the ink supply direction. In accordance with the structure of the present embodiment, too, it becomes possible to generate a comparatively fast flow rate on the sidewalls of the ink supply port 3 and the backside of the discharge port plate 5, as well as in the ink flow path 7, at the time of executing the suction recovery process as in the case of the third embodiment, thus performing the suction recovery process in good condition. Also, even if ink is mixed from the opening 28 at the time of executing the suction recovery process, it is possible to obtain the action that suppresses the dispersion thereof.

Further, the structure of the present embodiment differs from that of the third embodiment in the shape of the opening 28. In other words, for the present embodiment, the opening 28 is configured to be wider toward the discharge port side. Particularly, in accordance with the example shown in FIGS. 19A and 19B, It is trapezoidal. With the structure thus arranged, when the suction recovery process is executed, force is made to act on ink to flow toward the discharge port 27 side by the suction pressure exerted on the opening 28, hence making it possible to enable ink to flow in the ink flow path 7 efficiently. As a result, in accordance with the structure of the present embodiment, bubbles and overly viscous ink residing in the ink flow path 7 can be removed more efficiently by the suction recovery process to be performed in a better condition.

Next, with respect to the structure of the present embodiment, the example will be shown, in which a suction recovery process is specifically executed.

The recording element substrate 10 is formed to discharge an ink droplet of 4 pl, and the recording element substrate 11 is formed to discharge an ink droplet of 2 pl. For the discharge port arrays 20, 21, 22, 23, 24, and 25, there are arranged for any one of them 256 discharge ports at pitches of 600 DPI (42 μm interval) on one side of each ink supply port 3. Therefore, 512 discharge ports are arranged at pitches of 1,200 DPI (21 μm interval) in total on both sides each. The distance between centers of discharge port on both side, which is observed in the direction at right angles to the longitudinal axes of the ink supply port 3, that is, the distance between the centers of electrothermal converting members 1 on both sides, is 215 μm. Also, each width of the openings of the ink supply ports 3 on both sides where the electrothermal converting members 1 are formed is 115 μm. Also, the sectional area of each ink supply path 43 from each ink tank 42 to the ink jet recording head unit 41 is ϕ 1 mm. Here, the ink, viscosity of which is 2.2 CP at a temperature of 25° C., is used.

For the recording element substrate 10 that discharges ink droplets in a large discharge amount, the discharge port area is ϕ 15.5 μm, and the height of the ink flow path 7 (at a reference mark J in FIG. 19B) is 14.0 μm. The height from the electrothermal converting member 1 to the surface of the discharge port plate 5 (I+J in FIG. 19B) is 25.0 μm. The electrothermal converting member 1 is in a form of square of 24 μm long per side. Also, for the equally structured-ink flow path 7 shown in FIG. 19A, the dimension of each part is: A is 32 μm; B, 24 μm; C, 48.5 μm; D, 12.8 μm; E, 4.7 μm; F, 10 μm; and G, 14 μm.

For the recording element substrate 11 that discharges ink droplets in a small discharge amount, on the other hand, the discharge port area is ϕ 11.0 μm, and the height of the ink flow path (at a reference mark J in FIG. 19B) is 14.0 μm. The height from the electrothermal converting member 1 to the surface of the discharge port plate 5 (I+J in FIG. 19B) is 25.0 μm. The electrothermal converting member 1 is in a form of square of 22 μm long per side. Also, for the ink flow path 7 structured as shown in FIG. 19A, the dimension of each part is: A is 32 μm; B, 23 μm; C, 47.5 μm; D, 12.8 μm; E, 4.7 μm; F, 10 μm; and G, 14 μm.

The center-to-center distance H between the opening 28 and the discharge port 27 is 47.8 μm. The size of the opening 28 is: the width K on the discharge port 27 side, 12 μm; the width L on the ink supply port 3 side, 5 μm; and the length M in the direction of the ink flow path 7, 9.5 μm.

With the structural example thus provided, the suction recovery process is executed. Then, it is confirmed that bubbles are removed in good condition both in the discharge portion that discharges ink droplets in a large discharge amount and in the discharge portion that discharge ink droplets in a small discharge amount.

Here, in accordance with the present embodiment, it is possible to obtain the viscous plug phenomenon preventive effect as in the cases of the first and second embodiments. Also, as in the second embodiment, it is possible to obtain the action that enhances the discharge stability of ink droplets, as well as the capability of prompt refilling.

(Fifth Embodiment)

Figure 20A:
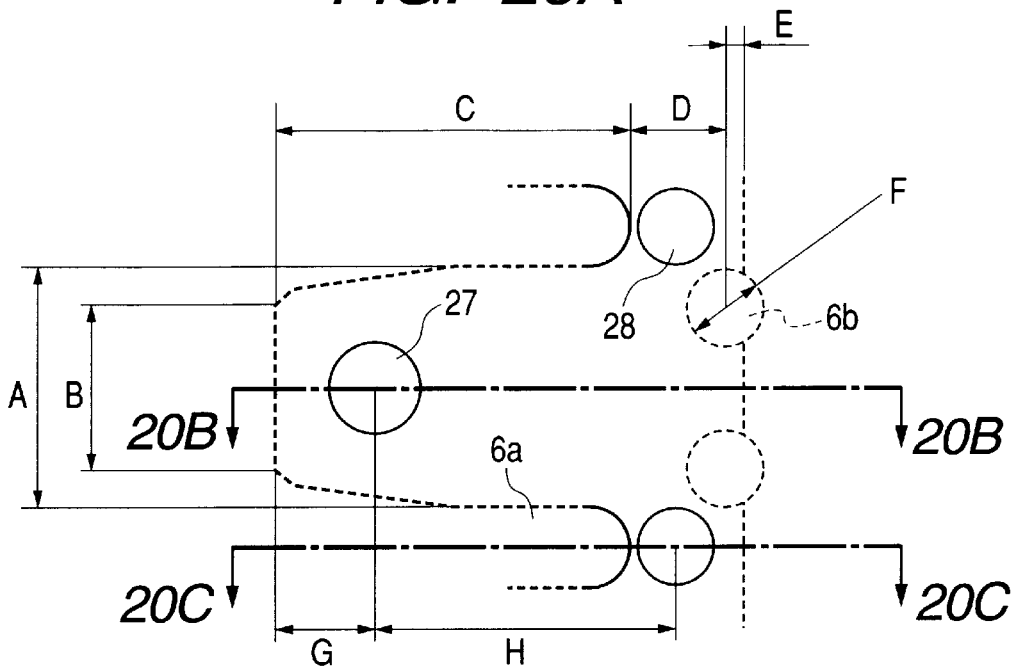
FIGS. 20A, 20B and 20C are views that schematically illustrate the nozzle portion of the recording element substrate for discharging ink droplet in a comparatively small discharge amount.
Figure 20B:
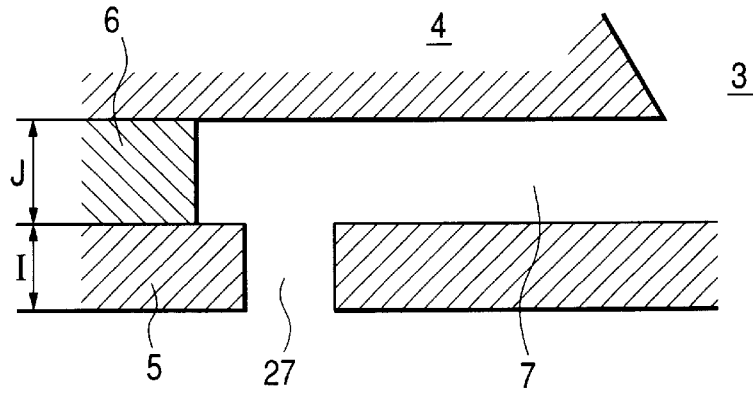
Figure 20C:
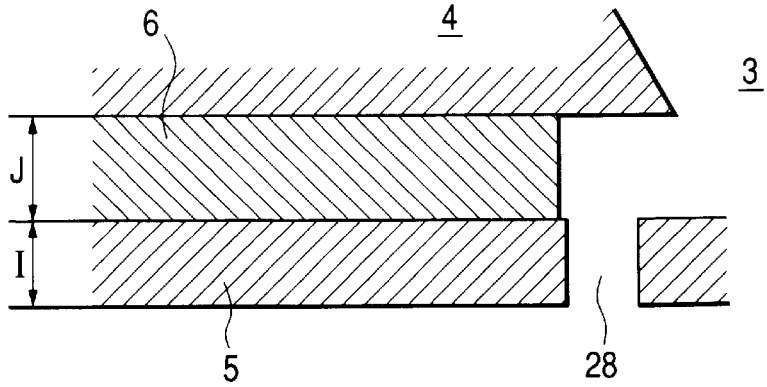

Next, with reference to FIGS. 20A, 20B, and 20C, the description will be made of a fifth embodiment in accordance with the present invention. For the present embodiment, the entire structure of the ink jet recording apparatus is the same as those of the first to fourth embodiments. Therefore, the detailed description thereof will be omitted. FIGS. 20A, 20B, and 20C are views that schematically illustrate the recording element substrate that discharges ink droplets in a small discharge amount. FIG. 20A is a plane view, FIG. 20B is a cross-sectional view taken along line 20B—20B in FIG. 20A, and FIG. 20C is a cross-sectional view taken along line 20C—20C in FIG. 20A.

For the present embodiment, the opening 28 is arranged on the extended line of the flow path wall 6*a*, which is out of the extended line of the ink flow path 7. In accordance with this structure, it is made possible to enable the ink, which flows toward the discharge port 27 along the extended line of the ink flow path 7, to flow toward the discharge port 27 without allowing it to flow out from the opening 28 on the way at the time of executing the suction recovery process. In this way, it is possible to enable ink to flow efficiently by use of the ink flow path 7. Moreover, with this structure, too, the provision of the opening 28 makes it possible to generate a fast flow rate on the sidewalls of the ink supply port 3 and the backside of the discharge port plate 5 at the time of executing the suction recovery process. Also, the flow resistance of the discharge portion having the small discharge port 27 provided therefor is made smaller to reduce difference with the flow rate of the discharge portion having the large discharge port 26 provided therefor, thus generating equal flow rates.

Here, for the structure of the present embodiment, it is preferable to provide the opening 28 more on the discharge port 27 side than the edge of the opening on the surface side of the ink supply port 3 where the electrothermal converting member 1 is provided. Then, even if ink is mixed at the time of executing the suction recovery process, it becomes possible to prevent the dispersion thereof. Also, the size of the opening 28 should preferably be made smaller than that of the discharge port 27 in order to prevent dust particles from entering from the opening 28.

Next, with respect to the structure of the present embodiment, the example will be shown, in which a suction recovery process is specifically executed.

The recording element substrate 10 is formed to discharge an ink droplet of 4 pl, and the recording element substrate 11 is formed to discharge an ink droplet of 2 pl. For the discharge port arrays 20, 21, 22, 23, 24, and 25, there are arranged for any one of them 256 discharge ports at pitches of 600 DPI (42 μm interval) on one side of each ink supply port 3. Therefore, 512 discharge ports are arranged at pitches of 1,200 DPI (21 μm interval) in total on both sides each. The distance between centers of discharge port on both side, which is observed in the direction at right angles to the longitudinal axes of the ink supply port 3, that is, the distance between the centers of electrothermal converting members 1 on both sides, is 215 μm. Also, each width of the openings of the ink supply ports 3 on both sides where the electrothermal converting members 1 are formed is 115 μm. Also, the sectional area of each ink supply path 43 from each ink tank 42 to the ink jet recording head unit 41 is ϕ 1 mm. Here, the ink, viscosity of which is 2.2 CP at a temperature of 25° C., is used.

For the recording element substrate 10 that discharges ink droplets in a large discharge amount, the discharge port area is ϕ 15.5 μm, and the height of the ink flow path 7 (at a reference mark J in FIG. 20B) is 14.0 μm. The height from the electrothermal converting member 1 to the surface of the discharge port plate 5 (I+J in FIG. 20B) is 25.0 μm. The electrothermal converting member 1 is in a form of square of 24 μm long per side. Also, for the equally structured-ink flow path 7 shown in FIG. 20A, the dimension of each part is: A is 32 μm; B, 24 μm; C, 48.5 μm; D, 12.8 μm; E, 4.7 μm; F, 10 μm; and G, 14 μm.

For the recording element substrate 11 that discharges ink droplets in a small discharge amount, on the other hand, the discharge port area is ϕ 11.0 μm, and the height of the ink flow path (at a reference mark J in FIG. 20B) is 14.0 μm. The height from the electrothermal converting member 1 to the surface of the discharge port plate 5 (I+J in FIG. 20B) is 25.0 μm. The electrothermal converting member 1 is in a form of square of 22 μm long per side. Also, for the ink flow path 7 structured as shown in FIG. 20A, the dimension of each part is: A is 32 μm; B, 22 μm; C, 47.5 μm; D, 12.8 μm; E, 4.7 μm; F, 10 μm; and G, 14 μm.

The center-to-center distance H between the opening 28 and the discharge port 27 in the direction of ink flow path 7 is 47.8 μm. The size of the opening 28 is ϕ 10 μm.

With the structural example thus provided, the suction recovery process is executed. Then, it is confirmed that bubbles are removed in good condition both in the discharge portion that discharges ink droplets in a large discharge amount and in the discharge portion that discharge ink droplets in a small discharge amount.

Here, in accordance with the present embodiment, it is possible to obtain the viscous plug phenomenon preventive effect as in the cases of the first and second embodiments. Also, as in the second embodiment, it is possible to obtain the action that enhances the discharge stability of ink droplets, as well as the capability of prompt refilling.

What is claimed is:

1. An ink jet recording head comprising:

a first discharge portion for discharging liquid from a first discharge port as liquid droplet in a specific amount;

a second discharge portion for discharging liquid from a second discharge port as liquid droplet in a larger amount than that of said first discharge portion; and an opening provided only for said first discharge portion, being open to the opening surface of said first discharge port and communicated with said first discharge port without discharging liquid droplet.

2. An ink jet recording head according to claim 1, wherein said first discharge port is smaller than said second discharge port.

3. An ink jet recording head according to claim 1, wherein said first discharge port is provided in the plural number, and said opening is provided corresponding to each of said first discharge ports individually.

4. An ink jet recording head according to claim 1, wherein said first discharge portion is provided on the substrate, and provided with a first energy generating element for generating energy to discharge liquid droplet, said first discharge port provided to face said first energy generating element, and a first liquid flow path communicated with said first discharge port for supplying liquid onto said first energy generating element, and said second discharge portion is provided on the substrate, and provided with a second energy generating element for generating energy to discharge liquid droplet, said second discharge port provided to face said second energy generating element, and a second liquid flow path communicated with said second discharge port for supplying liquid onto said second energy generating element, and said opening is provided for said first flow path communicated with said first discharge port.

5. An ink jet recording head according to claim 4, wherein said first discharge portion and said second discharge portion are provided on one substrate, and liquid is supplied to said first flow path and said second flow path from one liquid supply port provided on said substrate as a penetrated opening.

6. An ink jet recording head according to claim 4, wherein said opening is positioned on the downstream side of said first discharge port in the direction of supplying said liquid to said first discharge port in said first liquid flow path.

7. An ink jet recording head according to claim 6, wherein said opening is larger than said second discharge port.

8. An ink jet recording head according to claim 4, wherein said opening is positioned on the upstream side of said first discharge port in the direction of supplying said liquid to said first discharge port in said first liquid flow path.

9. An ink jet recording head according to claim 8, wherein said opening is smaller than said first discharge port.

10. An ink jet recording head according to claim 4, wherein said opening is positioned on the extend line of the flow path wall partitioning said adjacent first flow paths extended in the direction of supplying said liquid.

11. An ink jet recording head according to claim 4, wherein said opening is positioned on the center line of said first liquid flow path extended in the direction of supplying said liquid.

12. An ink jet recording head according to claim 4, wherein said first energy generating element and said second energy element are a first elecrothermal converting member and a second electrothermal converting member for generating thermal energy to discharge liquid as liquid droplet, respectively.

13. An ink jet recording head according to claim 12, wherein said first electrothermal converting member and second electrothermal converting member give liquid film boiling, and with the pressure exerted at that time, liquid is discharged as liquid droplet.

14. An ink jet recording head according to claim 13, wherein bubbles generated by film boiling are communicated with the atmosphere.

15. An ink jet recording head according to claim 1, wherein a first liquid supply port for supplying liquid to said first discharge port and a second liquid supply port for supplying liquid to said second discharge port are provided, respectively, and said opening is provided on the projected area of said opening surface of said first liquid supply port.

16. An ink jet recording head according to claim 15, wherein said discharge portion is provided with a first energy generating element for generating energy arranged on a first substrate to discharge liquid droplet, said first discharge port provided to face said first energy generating element, and a first liquid flow path communicated with said first discharge port for supplying liquid onto said first energy generating element, and said first liquid supply port provided on said first substrate as penetrated opening for supplying liquid to said first flow path, and said second discharge portion is provided with a second energy generating element arranged on a second substrate for generating energy to discharge liquid droplet, said second discharge port provided to face said second energy generating element, and a second liquid flow path communicated with said second discharge port for supplying liquid onto said second energy generating element, and said second flow path provided for said second substrate as penetrated opening for supplying liquid to said second liquid flow path.

17. An ink jet recording head according to claim 1, wherein said opening is formed in a shape having the portion of width becoming larger on the side nearer to said first discharge port.

18. An ink jet recording apparatus comprising:

an ink jet head according to claim 1; and a suction recovery unit for sucking out liquid from the discharge portion of said ink jet recording head.

19. An ink jet recording apparatus according to claim 18, wherein said suction recovery unit comprises a cap to cover and airtightly close the opening surface of said discharge port, and a suction pump for sucking liquid from said discharge port and said opening covered by said cap, wherein said suction pump sucks liquid at least from two kinds of said discharge portions of said ink jet recording head substantially on the same condition.

20. An ink jet recording apparatus according to claim 18, wherein said cap covers at least two kinds of said discharge portions of said ink jet recording head together.

* * * * *

UNITED STATES PATENT AND TRADEMARK OFFICE

CERTIFICATE OF CORRECTION

PATENT NO. : 6,755,510 B2 
DATED : June 29, 2004
INVENTOR(S) : Shuichi Murakami et al.

It is certified that error appears in the above-identified patent and that said Letters Patent is hereby corrected as shown below:

Column 1,
Line 19, "method," (both occurrences) should read -- methods, --;
Line 20, "method," should read -- methods, --; and "method" should read -- methods --;
Line 27, "color" should read -- colors --;
Line 28, "ink." should read -- of ink. --;
Line 40, "change" should read -- change, --;
Line 46, "mixture" should read -- addition --;
Line 47, "occurs" should read -- occur --;
Line 49, "the" (second occurrence) should be deleted;
Line 53, "ink" should read -- the ink --;
Line 54, "non-discharge) to change" should read -- non-discharge), changing --;
Line 56, "the" should be deleted;
Line 63, "suck" should read -- suction --;
Line 64, "head" should read -- head, --; and
Line 66, "sucked" should read -- suctioned --.

Column 2,
Lines 7, 9 and 10, "sucked" should read -- suctioned --;
Line 11, "the" should read -- this --;
Line 22, "on" should read -- in --;
Lines 26 and 30, "liquid" should read -- a liquid --;
Line 36, "cap," should read -- cap --;
Line 39, "easier to be" should read -- more easily --;
Line 41, "smaller to make" should read -- smaller, making --;
Line 44, "takes" should read -- may take --;
Line 46, "is" should read -- may be --; and
Line 47, "that" should read -- whereby --.

Column 3,
Line 9, "discharge ports nearby in" should read -- the large discharge portion near --;
Lines 17, 19 and 23, "liquid" should read -- a liquid --;
Line 27, "close" should read -- close in magnitude --;
Line 28, "suction" should read -- a suction --;
Line 31, "sucked" should read -- suctioned --;
Line 38, "drawback," should read -- drawbacks --;
Line 45, "making" should read -- increases in --; and
Line 46, "higher" should be deleted.

UNITED STATES PATENT AND TRADEMARK OFFICE

CERTIFICATE OF CORRECTION

PATENT NO. : 6,755,510 B2
DATED : June 29, 2004
INVENTOR(S) : Shuichi Murakami et al.

It is certified that error appears in the above-identified patent and that said Letters Patent is hereby corrected as shown below:

Column 4,
Lines 5 and 11, "liquid" should read -- a liquid --;
Line 31, "if" should read -- if a plurality of --;
Line 32, "port is provided in the plural number," should read -- ports are provided, --;
Line 50, "for another mode" (second occurrence) should be deleted; and
Line 65, "extend" should read -- extended --.

Column 5,
Line 14, "given to" should read -- caused in --;
Line 23, "sucks" should read -- suctions --;
Line 28, "sucking" should read -- suctioning --;
Line 30, "arrange" should read -- arrange it --; and "sucks" should read -- suctions --;
Line 32, "substantially on" should read -- under substantially --; and "condition." should read -- conditions. --;
Line 33, "two" should read -- the two --; and
Lines 39 and 50, "ink" should read -- an ink --.

Column 6,
Line 40, "vies" should read -- views --; and
Lines 49 and 55, "ink" should read -- an ink --.

Column 7,
Line 36, "M, Y" should read -- M, and Y --;
Line 39, "ports 3," should read -- ports 3 (see, e.g., FIGS. 1A and 1B, 3A and 3B), --;
Line 45, "each of" should be deleted; and "that color" should read -- those colors --;
Line 48, "droplet" should read -- droplets --;
Line 58, "recovery" should read -- a recovery --;
Line 62, "serial" should read -- a serial --; and
Line 63, "in" should read -- by --.

Column 8,
Line 1, "wiping" should read -- a wiping procedure --;
Line 4, "sucks" should read -- suctions --; and "ports" should read -- ports, --;
Line 17, "which are" should be deleted;
Line 18, "the opposite sides to each other, respectively." should read -- opposite sides. --;
Line 30, "moveable" should read -- movably --;
Line 31, "tions" should read -- tions, --; and "an arrow A in FIG. 9" should read -- a double-headed arrow in FIG. 9, --;
Line 36, "These" should read -- The --; and "wiper" should read -- and wiper --; and
Line 44, "cap" should read -- and cap --.

UNITED STATES PATENT AND TRADEMARK OFFICE

CERTIFICATE OF CORRECTION

PATENT NO. : 6,755,510 B2
DATED : June 29, 2004
INVENTOR(S) : Shuichi Murakami et al.

It is certified that error appears in the above-identified patent and that said Letters Patent is hereby corrected as shown below:

Column 9,
Line 2, "arrow D1" should read -- arrow D1 (FIG. 8) --;
Line 19, "contact" should read -- a contact --;
Line 23, "suck" should read -- suction --; and
Line 56, "carriage M4001" should read -- carriage 51 --.

Column 10,
Lines 17 and 30, "inside" should read -- the inside of --;
Line 19, "inside" should read -- the space inside --;
Lines 20, 22 and 23, "sucked" should read -- suctioned --;
Line 32, "is made" should read -- are made to have --;
Line 45, "inside" should read -- the space inside --; and
Line 67, "Each" should read -- The --.

Column 11,
Line 1, "member 1 is" should read -- members 1 are --;
Line 27, "each of" should be deleted;
Line 28, "each position" should read -- the positions --; and "each of" should be deleted;
Line 30, "the" should be deleted;
Line 32, "ports 27," should read -- ports 26, --;
Line 41, "Si" should read -- an Si --;
Line 44, "example)" should read -- example), --;
Line 47, "others" should read -- other elements --; and
Line 59, "dimension" should read -- dimensions --.

Column 12,
Line 1, "droplet." should read -- droplets. --; and "each of" should be deleted;
Line 2, "is arranged on each of" should read -- are arranged respectively at --;
Line 4, "each ink supply port 3" should read -- one of the ink supply ports 3 --; and "line" should read -- lines --;
Line 5, "line of each ink flow path 7, which extends" should read -- lines of the ink flow paths 7, which extend --;
Line 14, "plate 5" should read -- plate 5, --;
Line 15, "FIG. 21" should read -- FIG. 21, --; and "form" should read -- from --;
Line 20, "at" should read -- at a --;
Line 39, "closer" should read -- closer in magnitude --;
Line 46, "condition" should read -- conditions --;
Line 49, "sucked" should read -- suctioned --;
Line 61, "any" should read -- each --;
Line 64, "each." should read -- of each ink supply port 3. --; and
Line 65, "port on both side," should read -- ports on the two sides of an ink supply port 3, --.

UNITED STATES PATENT AND TRADEMARK OFFICE

CERTIFICATE OF CORRECTION

PATENT NO. : 6,755,510 B2
DATED : June 29, 2004
INVENTOR(S) : Shuichi Murakami et al.

It is certified that error appears in the above-identified patent and that said Letters Patent is hereby corrected as shown below:

Column 13,
Line 2, "both" should read -- the two --; and "each width of" should read -- the width of each of --;
Line 4, "Also," should read -- Also, the diameter of --;
Line 7, "ϕ 1 mm." should read -- 1 mm. --; and "the ink," should read -- ink, the --;
Line 16, "a form of" should read -- the form of a --;
Lines 17 and 38, "long" should be deleted;
Line 22, "form" should read -- from --;
Line 24, "inflow" should read -- ink flow --;
Line 37, "a form of" should read -- the form of a --;
Line 40, "dimension of part is arranged:" should read -- dimensions of this part are as follows: --;
Line 46, "the opening" should read -- each of the openings 28 --;
Line 47, "each of them is" should read -- they are --; and "for" should read -- for the --;
Line 48, "opening 28 is" should read -- openings 28 are --;
Line 55, "the" (first occurrence) should read -- (the --;
Line 56, "27/the" should read -- 27) / (the --;
Line 59, "plate 5>1" should read -- plate 5)>1, --;
Line 61, "ink" should read -- an ink --; and
Line 65, "with a" should read -- at a --.

Column 14,
Line 5, "discharges" should read -- discharges ink --;
Line 12, "portion" should be deleted;
Line 13, "27." should read -- 27 portion. --;
Line 19, "opening" should read -- opening 28 --; and "in" should read -- between --;
Line 20, "to" should read -- and --;
Line 36, "setting" should read -- the setting --;
Line 46, "droplet," should read -- droplets, --;
Line 48, "besides" should read -- in addition to --;
Line 49, "changes." should read -- changing. --;
Line 52, "large" should read -- larger --;
Line 55, "the" should be deleted;
Line 56, "portion that discharges" should read -- portions that discharge --; and "a" should be deleted;
Line 57, "amount." should read -- amounts. --;
Line 61, "recording," should read -- recording --;
Line 62, "These" should read -- The range of alternatives discussed above applies also to --; and
Line 63, "are the same for" should be deleted.

UNITED STATES PATENT AND TRADEMARK OFFICE

CERTIFICATE OF CORRECTION

PATENT NO. : 6,755,510 B2
DATED : June 29, 2004
INVENTOR(S) : Shuichi Murakami et al.

It is certified that error appears in the above-identified patent and that said Letters Patent is hereby corrected as shown below:

Column 15,
Line 3, "is the same for" should read -- applies to --;
Line 8, "the" (first occurrence) should read -- this --;
Line 10, "droplet" should read -- droplets --;
Line 13, "to be" should be deleted;
Line 26, "which are" should read -- both --;
Line 61, "shown," should read -- shown --; and
Line 67, "any" should read -- each --.

Column 16,
Line 3, "each." should read -- of each ink supply port 3. --;
Line 4, "port on both side," should read -- ports on the two sides of an ink supply port 3, --;
Line 8, "both" should read -- the two --; and "each width of" should read -- the width of each of --;
Line 11, "Also," should read -- Also, the diameter of --; and "each" (second occurrence) should read -- the corresponding --;
Line 12, "ϕ 1 mm." should read -- 1 mm. --;
Line 13, "the ink," should read -- ink, the --;
Line 29, "a form of" should read -- the form of a --;
Line 30, "long" should be deleted;
Line 45, "discharges" should read -- discharges ink --;
Line 56, "is the same for" should read -- also applies to --; and
Line 64, "the ink supply ports 3 on one side." should read -- discharge ports on either side of each ink supply port 3. --.

Column 17,
Line 2, "by two" should read -- in pairs --;
Line 5, "one side of the ink supply ports 3," should read -- a single side of an ink supply port 3, --;
Line 6, "When" should read -- when --;
Line 13, "this one." should read -- these. --;
Line 15, "the" (second occurrence) should read -- this --;
Line 27, "capillary" should read -- a capillary --;
Line 29, "ink" should read -- an ink --;
Line 40, "ink" should read -- an ink --; and "on" should read -- one --;
Line 41, "be" should read -- occur --;
Line 42, "along the" should read -- in --;
Line 45, "port" should read -- port, --;
Line 46, "ink" should read -- an ink --;
Line 55, "meniscus" should read -- the meniscus --; and
Line 66, "substrate 10" should read -- substrate 11 --.

UNITED STATES PATENT AND TRADEMARK OFFICE

CERTIFICATE OF CORRECTION

PATENT NO. : 6,755,510 B2
DATED : June 29, 2004
INVENTOR(S) : Shuichi Murakami et al.

It is certified that error appears in the above-identified patent and that said Letters Patent is hereby corrected as shown below:

Column 18,
Line 5, "strate 10" should read -- strate 11 --;
Lines 13, 25 and 54, "than" should read -- than is --;
Line 46, "ink" should read -- inks --;
Line 49, "sucked" should read -- suctioned --;
Line 51, "ink," should read -- the ink, --;
Line 55, "the" (first occurrence) should read -- an --;
Line 56, "lower." should read -- smaller. --; and "sucked" should read -- suctioned --;
Line 57, "mixed ink to" should read -- dispersion of the mixed ink into the --;
Line 58, "be dispersed into" should be deleted;
Line 60, "shown," should read -- shown --; and
Line 66, "any" should read -- each --.

Column 19,
Line 2, "each." should read -- of each ink supply port 3. --;
Line 3, "port on both side," should read -- ports on the two sides of an ink supply port 3, --;
Line 7, "both" should read -- the two --; and "each width of" should read -- the width of each of --;
Line 10, "Also," should read -- Also, the diameter of --; and "each" (second occurrence) should read -- the corresponding --;
Line 11, "ϕ 1 mm." should read -- 1 mm. --;
Line 12, "the ink," should read -- ink, the --;
Line 16, "(at" should read -- (analogous to --;
Line 19, "(I+J" should read -- (analogous to I+J --;
Line 20, "a form of" should read -- the form of a --;
Line 21, "long" should be deleted;
Line 22, "path 7" should read -- path 7 analogous to that --; and "dimension of each part" should read -- dimensions of the parts --;
Line 23, "is:" should read -- are: --;
Line 31, "a form of" should read -- the form of a --;
Line 32, "long" should be deleted;
Line 33, "dimension of each part" should read -- dimensions of the parts --; and
Line 34, "is:" should read -- are: --.

UNITED STATES PATENT AND TRADEMARK OFFICE

CERTIFICATE OF CORRECTION

PATENT NO. : 6,755,510 B2
DATED : June 29, 2004
INVENTOR(S) : Shuichi Murakami et al.

It is certified that error appears in the above-identified patent and that said Letters Patent is hereby corrected as shown below:

Column 20,
Line 4, "its difference with" should read -- it closer in magnitude to the flow resistance in --;
Line 6, "smaller accordingly" should be deleted;
Line 24, "opening" should read -- opening of the ink supply port 3 --;
Line 25, "provided" should read -- provided, --;
Line 33, "process" should read -- process, --;
Line 41, "be" should read -- become --;
Line 43, "It" should read -- it --;
Line 45, "force" should read -- a force --; and "to flow" should read -- to cause it to flow --;
Line 51, "to" should read -- so that it is --;
Line 52, "be" should be deleted;
Line 54, "shown," should read -- shown --;
Line 60, "any" should read -- each --;
Line 63, "each." should read -- of each ink supply port 3. --; and
Line 64, "port on both side," should read -- ports on the two sides of an ink supply port 3, --.

Column 21,
Line 1, "both" should read -- the two --; and "width of" should read -- the width of each of --;
Line 4, "Also," should read -- Also, the diameter of --; and "each" (second occurrence) should read -- the corresponding --;
Line 5, "ϕ 1 mm." should read -- 1 mm. --;
Line 6, "the ink," should read -- ink, the --;
Line 10, "(at" should read -- (analogous to --;
Line 13, "(I+J" should read -- (analogous to I+J --;
Line 14, "a form of" should read -- the form of a --;
Line 15, "long" should be deleted;
Line 16, "path 7" should read -- path 7 analogous to that --; and "dimension of each part" should read -- dimensions of the parts --;
Line 17, "is:" should read -- are: --;
Line 25, "a form of" should read -- the form of a --;
Line 26, "long" should be deleted;
Line 27, "dimension of each part" should read -- dimensions of the parts --;
Line 28, "is:" should read -- are: --;
Line 39, "discharge" (second occurrence) should read -- discharges --; and
Line 63, "of" (first occurrence) should read -- of the range of --.

UNITED STATES PATENT AND TRADEMARK OFFICE

CERTIFICATE OF CORRECTION

PATENT NO. : 6,755,510 B2
DATED : June 29, 2004
INVENTOR(S) : Shuichi Murakami et al.

It is certified that error appears in the above-identified patent and that said Letters Patent is hereby corrected as shown below:

Column 22,
Line 8, "to reduce" should read -- so as to make its magnitude closer to that --;
Line 9, "difference with the flow rate" should be deleted;
Line 22, "shown," should read -- shown --;
Line 28, "any" should read -- each --;
Line 31, "each." should read -- of each ink supply port 3. --;
Line 32, "port on both side," should read -- ports on the two sides of an ink supply port 3, --;
Line 36, "both" should read -- the two --; and "each width of" should read -- the width of each of --;
Line 39, "Also," should read -- Also, the diameter of --; and "each" (second occurrence) should read -- the corresponding --;
Line 40, "ϕ 1 mm." should read -- 1 mm. --;
Line 41, "the ink," should read -- ink, the --;
Line 45, "(at a" should read -- (analogous to a --;
Line 48, "(I+J" should read -- (analogous to I+J --;
Line 49, "a form of" should read -- the form of a --;
Line 50, "long" should be deleted;
Line 51, "path 7" should read -- path 7 analogous to that --; and "dimension of each part" should read -- dimensions of the parts --;
Line 52, "is:" should read -- are: --;
Line 60, "a form of" should read -- the form of a --;
Line 61, "long" should be deleted;
Line 62, "dimension of each part" should read -- dimensions of the parts --; and
Line 63, "is:" should read -- are: --.

UNITED STATES PATENT AND TRADEMARK OFFICE

CERTIFICATE OF CORRECTION

PATENT NO. : 6,755,510 B2 
DATED : June 29, 2004
INVENTOR(S) : Shuichi Murakami et al.

It is certified that error appears in the above-identified patent and that said Letters Patent is hereby corrected as shown below:

Column 23,
Line 4, "discharge" (second occurrence) should read -- discharges --.

Signed and Sealed this

Twenty-third Day of August, 2005

JON W. DUDAS
*Director of the United States Patent and Trademark Office*